US010670999B2

(12) United States Patent
Yamada

(10) Patent No.: US 10,670,999 B2
(45) Date of Patent: Jun. 2, 2020

(54) IMAGE FORMING APPARATUS

(71) Applicant: CANON KABUSHIKI KAISHA, Tokyo (JP)

(72) Inventor: Toshiyuki Yamada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/179,286

(22) Filed: Nov. 2, 2018

(65) Prior Publication Data

US 2019/0129333 A1 May 2, 2019

(30) Foreign Application Priority Data

Nov. 2, 2017 (JP) ..... 2017-213277

(51) Int. Cl.
*G03G 15/16* (2006.01)
*G03G 15/00* (2006.01)
*G03G 15/01* (2006.01)

(52) U.S. Cl.
CPC ..... *G03G 15/168* (2013.01); *G03G 15/0189* (2013.01); *G03G 15/1675* (2013.01); *G03G 15/5029* (2013.01); *G03G 15/5037* (2013.01); *G03G 15/6591* (2013.01); *G03G 2215/1652* (2013.01)

(58) Field of Classification Search
CPC ..... G03G 15/168; G03G 15/1675; G03G 15/5029; G03G 2215/1647; G03G 2215/1652
See application file for complete search history.

(56) References Cited

U.S. PATENT DOCUMENTS 6,990,300 B2 1/2006 Saito et al.
9,098,020 B2 8/2015 Aiba
2008/0037038 A1* 2/2008 Arai ..... G03G 15/161 358/1.2
2014/0064754 A1* 3/2014 Hara ..... G03G 15/2039 399/43
2015/0355572 A1* 12/2015 Saitoh ..... G03G 15/0849 399/30

FOREIGN PATENT DOCUMENTS

JP 2004-145297 A 5/2004
JP 2007-334011 A 12/2007
JP 2012-042641 A 3/2012
JP 2013-045057 A 3/2013
JP 2015-099234 A 5/2015

* cited by examiner

*Primary Examiner* — Thomas S Giampaolo, II
(74) *Attorney, Agent, or Firm* — Venable LLP

(57) ABSTRACT

An image forming apparatus includes an image transfer belt; a first transfer member; a second transfer member opposed to the first transfer member with the belt therebetween; an applying device for applying a voltage to at least one of the first and second transfer members; and a controller for controlling the applying device to apply to the at least one transfer member a voltage having the same polarity as a regular polarity of toner and a voltage of the opposite polarity to the first transfer member in a cleaning operation. The controller changes a number of image formations to be carried out from a cleaning operation to a next cleaning operation depending on the kind of the sheet. The number controlled by the controller is different depending on the kind of the sheets in a continuous printing job.

3 Claims, 11 Drawing Sheets

IMAGE FORMING APPARATUS

FIELD OF THE INVENTION AND RELATED ART

The present invention relates to an image forming apparatus, such as a copying machine, a printing machine, and a facsimile machine, which uses an electrophotographic image formation method, an electrostatic image recording method, or the like.

An image forming apparatus which uses an electrophotographic image forming method or the like outputs an image by forming a toner image on its image bearing member, and transferring the toner image onto transfer medium such as a sheet of recording paper. Transfer of a toner image onto a transfer medium is done by applying voltage to a transferring member which holds transfer medium by pinching the transfer medium between itself and the image bearing member. As a transferring member, a roller (transfer roller) is frequently used, from the standpoint of stability in the contact between itself and the image bearing member. Further, in order to enable an image forming apparatus such as the one described above to form a high quality image on various transfer media, a so-called intermediary transferring system has been widely employed. In the case of an image forming apparatus of the intermediary transfer type, a toner image is transferred (primary transfer) onto the second image bearing member such as an intermediary transfer belt, and then, the toner image is transferred (secondary transfer) from the second image bearing member onto a transfer medium such as a sheet of recording paper, from the secondary transferring member. These transferring processes are described in greater detail with reference to an image forming apparatus of the intermediary transfer type, which is provided with the intermediary transfer belt as the secondary image bearing member, and a secondary transfer roller as the secondary transferring member.

As an image forming process is repeated by an image forming apparatus of the aforementioned type, toner continues to adhere to the peripheral surface of the secondary transfer roller, and accumulate thereon. This accumulation of toner on the peripheral surface of the secondary transfer roller is likely to occur across the portions of the intermediary transfer belt, across which images are not formed (portions which do not come into contact with the transfer medium in the secondary transferring portion); the fog generating toner having adhered to the portions of the intermediary transfer belt, which correspond to sheet intervals, adheres to the secondary transfer roller. As the fog generating toner accumulates on the peripheral surface of the secondary transfer roller, it transfers onto the back surface of the transfer medium, soiling thereby the back surface of the transfer medium. Thus, it is necessary to clean the peripheral surface of the secondary transfer roller.

There are a few structural arrangements for an image forming apparatus, which are for preventing the problems attributable to the toner accumulation on the peripheral surface of the secondary transfer roller, such as the one described above. According to one of them, a cleaning member is placed in contact with the secondary transfer roller to remove the toner having accumulated on the peripheral surface of the secondary transfer roller (Japanese Laid-open Patent Application No. 2007-334011). According to another one, a preset bias is applied to the secondary transfer roller to remove the toner having accumulated on the peripheral surface of the secondary transfer roller (Japanese Laid-open Patent Application No 2004-145297).

SUMMARY OF THE INVENTION

The structural arrangement for placing a cleaning member in contact with the secondary transfer roller as disclosed in Japanese Laid-open Patent Application No. 2007-334011 is likely to increase an image forming apparatus in size and/or cost. In comparison, the structural arrangement for applying a preset bias to a secondary transfer roller is advantageous in terms of cost reduction and/or size reduction. This structural arrangement, however, does not allow an image forming apparatus to form an image during a cleaning period. Therefore, if a cleaning operation is carried out more often than necessary, an image forming apparatus is substantially reduced in productivity.

On the other hand, it became evident that the amount by which toner accumulates on the peripheral surface of a secondary transfer roller is affected by the type of transfer medium, smoothness level of transfer medium, speed with which transfer medium is conveyed through the secondary transferring portion, and/or the like factors.

Therefore, the primary object of the present invention is to provide an image forming apparatus which does not carry out the operation for cleaning its transferring member for an unnecessarily length of time, and therefore, is not significantly reduced in productivity by the operation for cleaning its transferring member.

The object of the present invention described above is achieved by an image forming apparatus which is in accordance with the present invention. In essence:

According to an aspect of the present invention, there is provided an image forming apparatus comprising a belt configured to a toner image; a first transfer member contacting an outer peripheral surface of said belt and configured to transfer the toner image from said belt onto a transfer material; a second transfer member opposed to said first transfer member with said belt therebetween to form a transfer portion in cooperation with said first transfer member; an applying device configured to apply a voltage at least one of said first and second transfer members; an input portion configured to input a kind of the transfer material onto which the image is to be transferred; and a controller configured to control said applying device to apply to said at least one transfer member a voltage having a polarity same as a regular charge polarity of toner and a voltage having a polarity opposite to the regular charge polarity for respective predetermined periods to perform a cleaning operation for removing the toner deposited on said first transfer member, in a duration after a transfer material passes through said transfer portion and before a next transfer material reaches the transfer portion, in a continuous job for transferring images onto transfer materials continuously; wherein said controller is capable of changing a number of image formations to be carried out from performance of the cleaning operation to next performance of the cleaning operation, on the basis of the kind of the transfer material inputted by said input portion, and wherein the number controlled by said controller when the continuous job is carried out under a predetermined ambient condition is a first number in a case of a first continuous job in which the kinds of the transfer materials are all coated paper, and is a second number in a case of a second continuous job in which the kinds of the transfer materials are all plain paper, wherein the second number is smaller than the first number.

Further features of the present invention will become apparent from the following description of exemplary embodiments with reference to the attached drawings.

DESCRIPTION OF THE EMBODIMENTS

Hereinafter, the present invention will be described in greater detail, with references to drawings of the image forming apparatuses which are in accordance with the present invention.

[Embodiment 1]

1. Overall Structure and Operation of Image Forming Apparatus

Figure 1:
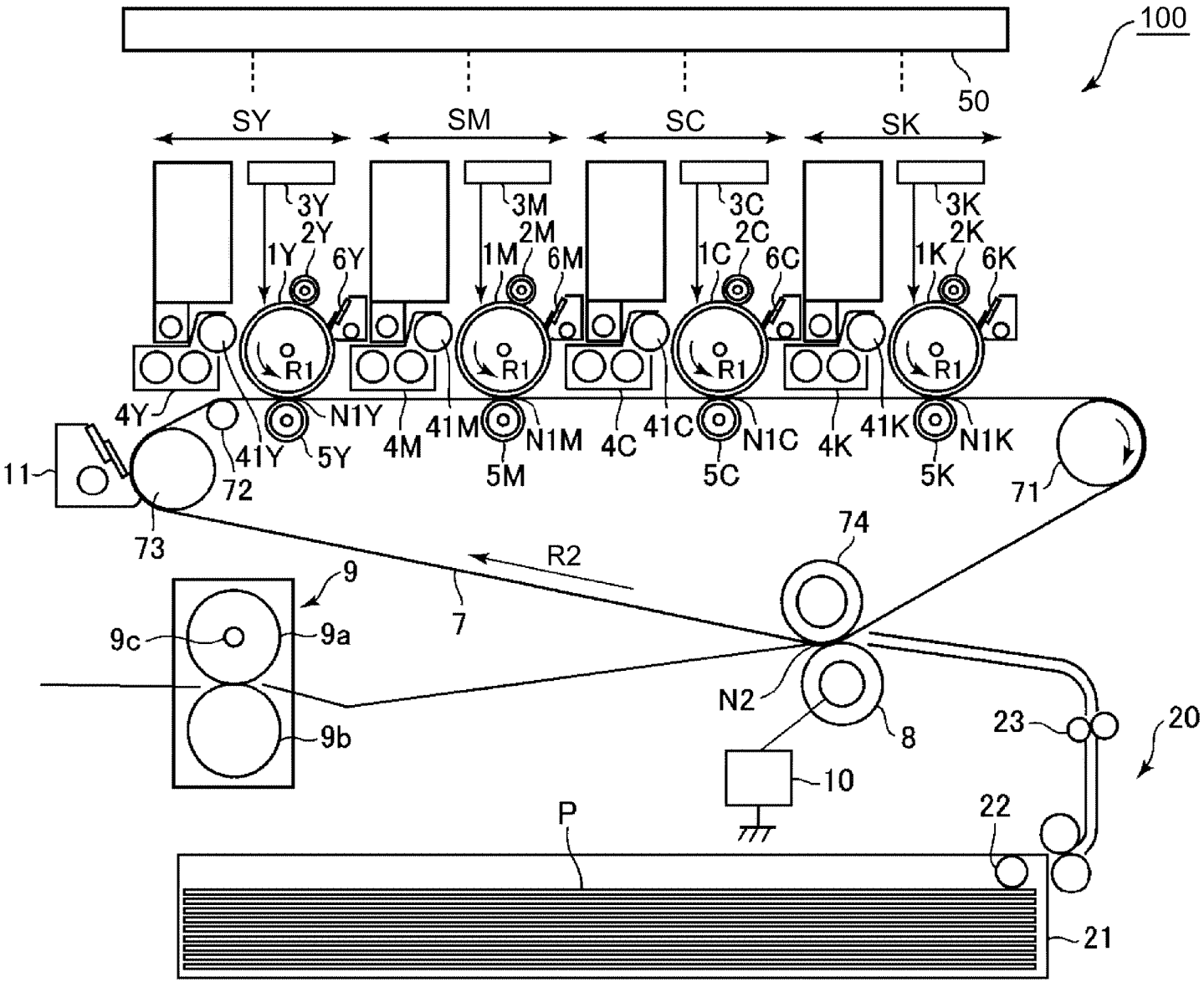
FIG. 1 is a schematic sectional view of a typical image forming apparatus to which the present invention is applicable.

FIG. 1 is a schematic sectional view of the image forming apparatus 100 in this embodiment. The image forming apparatus 100 in this embodiment is such an image forming apparatus that can form a full-color image with the use of an electrophotographic image forming method. It is of the so-called tandem type, and employs an intermediary transferring method.

The image forming apparatus 100 has multiple image forming portions (stations), more specifically, the first, second, third and fourth image forming portions SY, SM, SC and SK, which form yellow (Y), magenta (M), cyan (C) and black (K) toner images, respectively. The four image forming portions SY, SM, SC and SK are practically the same in structure and function, although they are different in the color of the toner image they form. Thus, the suffixes Y, M, C and K, which indicate the color of the image they form, may be sometimes omitted to describe the four image forming portions together. In this embodiment, each image forming portion S is made up of a photosensitive drum 1, a charge roller 2, an exposing apparatus 3, a developing apparatus 4, a primary transfer roller 5, a drum cleaning apparatus 6, etc.

The photosensitive drum 1 is an image bearing member (first image bearing member) which bears a toner image. It is a photosensitive member (electrophotographic photosensitive member), which is in the form of a cylindrical drum. It is rotationally driven in the direction (counterclockwise direction) indicated by an arrow mark R1 in FIG. 1, at a preset peripheral velocity. As the photosensitive drum 1 is rotated, its peripheral surface is uniformly charged to preset polarity ("negative" in this embodiment) and preset potential level by the charge roller 2 as a charging means. The charge roller 2 is a charging member which is in the form of a roller. It is rotated by the rotation of the photosensitive drum 1. During a charging process, preset charge voltage (charge bias) is applied to the charge roller 2 by an unshown charge voltage power source. The uniformly charged portion of the peripheral surface of the photosensitive drum 1 is scanned by (exposed to) the exposing apparatus 3 as an exposing means. As a result, an electrostatic image (electrostatic latent image) is formed on the peripheral surface of the photosensitive drum 1. In this embodiment, the exposing apparatus 3 is a laser scanner. It exposes the peripheral surface of the photosensitive drum 1 by scanning the peripheral surface of photosensitive drum 1 with a beam of laser light it emits while turning on or off the beam based on the information about the image to be formed.

The electrostatic image formed on the photosensitive drum 1 is developed (turned into visible image) by the developing apparatus 4 as a developing means. More specifically, the peripheral surface of the photosensitive drum 1 is supplied with toner (developer) by the developing apparatus 4. As a result, a toner image (visible image) is formed on the photosensitive drum 1. The developing apparatus 4 has a development roller 41 as a developer bearing member for conveying toner to the area in which its peripheral surface opposes the peripheral surface of the photosensitive drum 1. During a development process, preset development voltage (development bias) is applied to the development roller 41 by an unshown development voltage power source. In this embodiment, toner is charged to the same polarity as the photosensitive drum 1, and adheres to the exposed points (portions) of the peripheral surface of the photosensitive drum 1, which have reduced in potential level (in terms of absolute value) by being exposed after being uniformly charged (image portion exposure; reversal development). In this embodiment, the normal toner charge polarity, which is the same as the toner charge polarity during a development process, is negative.

The image forming apparatus 100 is provided with an intermediary transfer belt 7, which is an endless belt, as an image bearing member (secondary image bearing member) for bearing a toner image. The intermediary transfer belt 7 is positioned so that it opposes the peripheral surface of each of the aforementioned four photosensitive drums 1. The intermediary transfer belt 7 is an example of intermediary transferring member for conveying a toner image to a sheet of transfer medium P after the toner image is transferred (primary transfer) onto the intermediary transfer belt 7 from the photosensitive drum 1. It is suspended by multiple supporting members, more specifically, a driving roller 71, an auxiliary roller 72, a tension roller 73, and a belt backing roller 74 (inside secondary transfer roller), in such a manner that it bridges between the adjacent two supporting rollers, and also, that it is provided with a preset amount of tension. To the intermediary transfer belt 7, driving force is transmitted by the driving roller 71 so that it is rotated (circularly moved) in the direction (clockwise direction) indicated by an arrow mark R2 in FIG. 1, at the same peripheral velocity (process speed) as that of the photosensitive drum 1. In this embodiment, the peripheral velocity (speed with which peripheral surface moves) of the intermediary transfer belt 7 is 250 (mm/sec). On the inward side of the inward surface of the intermediary transfer belt 7, a primary transfer roller 5, which is a primary transferring member, is positioned in such a manner that it opposes the photosensitive drum 1. The primary transfer roller 5 is a primary transferring means, and is in the form of a roller. It is kept pressed toward the photosensitive drum 1, with the presence of the intermediary transfer belt 7 between itself and photosensitive drum 1, forming thereby a primary transferring portion N1 (primary transfer nip), in which the photosensitive drum 1 and intermediary transfer belt 7 contact with each other. In the primary transferring portion N1, a toner image formed on the photosensitive drum 1 as described above is transferred (primary transfer) onto the rotating intermediary transfer belt 7 by the function of the primary transfer roller 5. During a primary transfer process, primary transfer voltage (primary transfer bias) is applied to the primary transfer roller 5 by an unshown primary transfer power source. The primary transfer voltage is DC voltage, and is opposite in polarity (positive in this embodiment) from the normal toner charge. In an operation for forming a full-color image, for example, yellow, magenta, cyan and black toner images are formed on the four photosensitive drums 1, one for one, and are sequentially transferred onto the intermediary transfer belt 7 in such a manner that they are sequentially layered on the intermediary transfer belt 7.

The image forming apparatus 100 is also provided with a secondary transfer roller 8 (outside secondary transfer roller) as a secondary transferring means. The secondary transfer roller 8 is in the form of a roller. It is positioned on the outward surface side of the intermediary transfer belt 7, in such a manner that it opposes the belt backing roller 74. The secondary transfer roller 8 (outside secondary transfer roller) is kept pressed toward the belt backing roller 74, with the presence of the intermediary transfer belt 7 between itself and the belt backing roller 74, forming thereby a secondary transferring portion N2 (secondary transfer nip), at which the intermediary transfer belt 7 and secondary transfer roller 8 remain in contact with each other. In the secondary transferring portion N2, a toner image formed on the intermediary transfer belt 7 as described above is transferred onto a sheet of transfer medium P such as recording paper by the function of the secondary transfer roller 8 while the sheet P is conveyed through the secondary transferring portion N2, remaining pinched between the intermediary transfer belt 7 and secondary transfer roller 8. During a secondary transfer process, secondary transfer voltage (secondary transfer bias) is applied to the secondary transfer roller 8 by a secondary transfer power source 10 as a voltage applying means. The secondary transfer voltage is DC voltage and is opposite in polarity (positive in this embodiment) from the normal toner charge. The belt backing roller 74 is grounded (connected to ground).

A sheet of transfer medium P is conveyed to the secondary transferring portion N2 by a feeding-conveying apparatus 20. More specifically, the image forming apparatus 100 is provided with a cassette 21, as a storing portion, in which multiple sheets of transfer medium P are stored. Further, the feeding-conveying apparatus 20 is provided with a pickup roller 22. It moves the sheets P one by one out of the cassette 21 with its pickup roller 22, and supplies the secondary transferring portion N2 with each sheet P, in coordination with a pair of conveyance rollers 23, as a conveying member, and/or the like, with such timing that each sheet p arrives at the secondary transferring portion N2 at the same time as the toner image on the intermediary transfer belt 7.

After the transfer of a toner image onto a sheet of transfer medium P, the sheet is conveyed to a fixing apparatus 9 as a fixing means, which has: a fixation roller 9*a* as a fixing member; a pressure roller 9*b*, as a pressure applying means, which is kept pressed upon the fixation roller 9*a*; and a heater 9*c*, as a heating means, such as a halogen lamp. The fixing apparatus 9 fixes (melts and solidifies) an unfixed toner image on the sheet to the sheet by heating and pressing the sheet and the toner image thereon by conveying the sheet with the use of its fixation roller 9*a* and pressure roller 9*b* while pinching the sheet and the toner image thereon. Thereafter, the sheet is discharged (outputted) from the main assembly of the image forming apparatus 100.

On the other hand, adherent substances, such as toner (primary transfer residual toner) which failed to be transferred onto the intermediary transfer belt 7 during a primary transfer process, and therefore, are remaining on the peripheral surface of the photosensitive drum 1, are removed from the peripheral surface of the photosensitive drum 1 and recovered, by the drum cleaning apparatus 6 as a photosensitive member cleaning means. The drum cleaning apparatus 6 is provided with a cleaning blade, as a cleaning member, disposed in contact with the photosensitive drum 1, and a container. It scrapes away the aforementioned adherent substances from the peripheral surface of the photosensitive drum 1 as the photosensitive drum 1 is rotated, and stores the removed adherent substances into the container. Further, the image forming apparatus 100 is provided with a belt cleaning apparatus 11 as a means for cleaning the intermediary transferring member. The belt cleaning apparatus 11 is positioned on the outward side of the outward surface of the intermediary transfer belt 7, in such a manner that it opposes the tension roller 73. The toner (secondary transfer residual toner) which failed to be transferred onto a sheet of transfer medium P during the secondary transfer process, and therefore, is remaining on the surface (outward surface) of the intermediary transfer belt 7, and other adherent substances such as paper dust remaining on the outward surface of the intermediary transfer belt 7, are removed and recovered by the belt cleaning apparatus 11. The belt cleaning apparatus 11 is provided with a cleaning blade, as a cleaning member, which is disposed in contact with the intermediary transfer belt 7, and a container. It scrapes away the adherent substances from the outward surface of the intermediary transfer belt 7, and stores the removed adherent substances in the container.

In this embodiment, the intermediary transfer belt 7 is an endless belt formed of resinous substance. As the resinous material for the intermediary transfer belt 7, polycarbonate, and fluorine resins (ETFE, PVDF, for example), can be used, for example, although the choice is not limited to the listed ones. To the material for the resinous layer described above, electrically conductive agents for adjusting the material for the intermediary transfer belt 7, in the value of its electrical resistance, is added. As the electrically conductive agents, carbon black and graphite, for example, can be used, although the choice does not need to be limited to the abovementioned ones. In this embodiment, an endless belt formed of PI (polyimide) was used as the intermediary transfer belt 7. It was 70 μm in thickness, and $10^{11}\Omega/\square$ in surface resistivity (measured with use of probe which was in accordance with JIS-K6911, under such condition that applied voltage was 100 V; length of time voltage was applied was 60 sec.; and humidity was 23° C./50%). However, the choice of the intermediary transfer belt 7 does not need to be limited to the one used in this embodiment. The intermediary transfer belt 7 may be different from the one in this embodiment, in material, electrical properties, and thickness.

In this embodiment, the primary transfer roller 5 is made up of a metallic core (core member), and an electrically conductive elastic layer which is cylindrically formed on the peripheral surface of the metallic core, in a manner to envelop the metallic core. In this embodiment, the metallic core was 8 mm in external diameter. The electrically conductive elastic layer is 4 mm in thickness, and is formed of electrically conductive urethane sponge. In this embodiment, the value of the electrical resistance of the primary transfer roller 5 was roughly $10^7\Omega$ (23° C./50% RH). By the way, the value of the electrical resistance of the primary transfer roller 5 was measured with the use of the following method. That is, the primary transfer roller 5 was rotated at a peripheral velocity of 50 mm/sec while it was kept in contact with a grounded metallic roller by 500 g of load. Then, the amount by which electrical current was flowed was measured while the primary transfer roller 5 was rotated at a peripheral velocity of 50 mm/sec, and 500 V of voltage was applied to the metallic core of the primary transfer roller 5. Then, the value of the electrical resistance of the primary transfer roller 5 was obtained from the measured current value.

In this embodiment, the secondary transfer roller 8 is made up of a metallic core (core member), and an electrically conductive elastic layer cylindrically formed on the peripheral surface of the metallic core. In this embodiment, the external diameter of the metallic core was 10 mm. The electrically conductive elastic layer was 4 mm in thickness, and was electrically conductive. It was a sponge layer formed of EPDM. Further, in this embodiment, the value of the electrical resistance of the secondary transfer roller 8 was measured with the use of a measuring method which was similar to the one used to measure the electrical resistance of the primary transfer roller 5 described above. When the voltage applied to the secondary transfer roller 8 was 2000 V, the electrical resistance value of the secondary transfer roller 8 was roughly $10^8\Omega$.

The image forming apparatus 100 begins to carry out a job (printing operation) in response to a start command. A job is a collection of sequential steps (processes) for forming an image on a single sheet of transfer medium P, and output the sheet, or multiple sheets of transfer medium P, and outputs the sheets. Generally speaking, a job comprises a pre-rotation step, an image formation step, and a post-rotation step. In a case where an image is formed on multiple sheets of transfer medium P, a job comprises a sheet interval step in addition to the abovementioned one. An image formation step corresponds to a period in which an electrostatic image of the image to be formed is formed on a sheet of transfer medium P and outputted; a toner image is formed; and the toner imaged transferred onto the intermediary transfer belt 7, and then, is transferred onto the sheet. The image formation period is this period. To describe in greater detail, the electrostatic image formation step, toner image formation step, primary transfer step, and secondary transfer step are different in position and timing. The pre-rotation step corresponds to the period from when an image formation start command is inputted to when an image begins to be actually formed. It corresponds to a period immediately before the image formation step. That is, it corresponds to a period in which a preparatory operation is carried out. A sheet interval step corresponds to a period (periods) which corresponds to the interval between the consecutively conveyed two sheets of transfer medium P when images are continuously formed on multiple sheets of transfer medium P (continuous image formation). The post-rotation step is a step which follows the image formation step. It corresponds to a period in which the image forming apparatus 100 is prepared for the next image formation step. An idling period (period in which no image is formed) corresponds to any period other than the image formation period. It includes, the pre-rotation period, sheet interval period, post-rotation period. It includes also the preparatory multi-rotation step, that is, the preparatory step, which is to be carried out right after the image forming apparatus 100 is turned on, or the image forming apparatus 100 was awakened while it was kept asleep. In this embodiment, the cleaning operation for cleaning the secondary transfer roller 8, which will be described later in detail, is carried out during the idling period, or the period in which no image is formed.

2. Operation for Cleaning Secondary Transfer Roller

Next, the operation for cleaning the secondary transfer roller 8 is described.

As the image forming apparatus 100 is used for a long period of time, or it is used for a certain length of time in an ambience which is high in humidity, the following phenomena sometimes occur. That is, some toner particles stored in the developing apparatus 4 turn into such toner particles that cannot hold electrical charge by a sufficient amount (which hereafter may be referred to as "low-tribo toner particles", such toner particles that are opposite in polarity from the normal toner charge (which hereafter may be referred to as "reversally charged toner particles"). If this phenomena occur, the so-called "fogging", that is, a phenomenon that these low-tribo toner particles and/or reversely charge toner particles transfer onto the unexposed portions of the peripheral surface of the photosensitive drum 1, that is, the portion of the peripheral surface of the photosensitive drum 1, which correspond to the sheet interval (which occurs between consecutively conveyed two sheets of transfer medium P in secondary transferring portion N2), and that which corresponds to the portion of the peripheral surface of the photosensitive drum 1, which moves through the area in which the peripheral surface of the photosensitive drum 1 opposes the peripheral surface of the development roller 41. Some of "fog generation toner particles", that is, those which transferred onto the unexposed portion of the photosensitive drum 1 transfer onto the portions of the intermediary transfer belt, which correspond to the sheet interval portions of the intermediary transfer belt 7. These "fog formation toner particles" on the sheet interval portion of the intermediary transfer belt 7 do not directly transfer onto a sheet of transfer medium P in the secondary transferring portion N2. Instead, they directly transfer onto the secondary transfer roller 8. Therefore, as an image forming operation is repeated, the fog generation toner particles gradually accumulate on the secondary transfer roller 8. Eventually, "back soiling" that is, a problem that the fog generation toner particles which accumulated on the peripheral surface of the secondary transfer roller 8 adhere to the back surface of the sheet of transfer medium P, in the secondary transferring portion N2, when the sheet is conveyed through the secondary transferring portion N2, sometimes occurs.

By the way, the fog occurs also on the image formation area of the peripheral surface of the photosensitive drum 1, that is, the area of the peripheral surface of the photosensitive drum 1, across which a toner image is formed. Some of these fog formation toner particles transfer onto the intermediary transfer belt 7. However, the fog formation toner particles on the image formation area of the photosensitive drum 1 directly transfer onto a sheet of transfer medium P in the secondary transferring portion N2; they do not directly transfer onto the secondary transfer roller 8. Further, the amount by which the fog formation toner particles transfer onto the sheet of transfer medium P is proportional to the formation of a single image. Therefore, the amount is small enough for the "back soiling" attributable to these toner particles to be practically inconspicuous. Thus, it may be said that the effect which the fog formation toner particles from the image formation area of the photosensitive drum 1 have on the image formed on the sheet P is not substantial.

In this embodiment, the image forming apparatus 100 is made to carry out an operation for electrostatically cleaning the secondary transfer roller 8, in order to prevent toner from accumulating on the peripheral surface of the secondary transfer roller 8. The electrostatic cleaning operation is carried out as follows. That is, such bias that is the same in polarity as the normal toner charge, or opposite in polarity from the normal toner charge is applied to the secondary transfer roller 8 by the secondary transfer power source 10 for a preset length of time. With the application of the bias to the secondary transfer roller 8, toner is moved from the secondary transfer roller 8 onto the intermediary transfer belt 7. Thus, the toner on the peripheral surface of the secondary transfer roller 8 is reduced. In this embodiment, the toner particles which moved to the intermediary transfer belt 7 from the secondary transfer roller 8 are removed from the surface of the intermediary transfer belt 7 and recovered by the belt cleaning apparatus 11.

Figure 2:
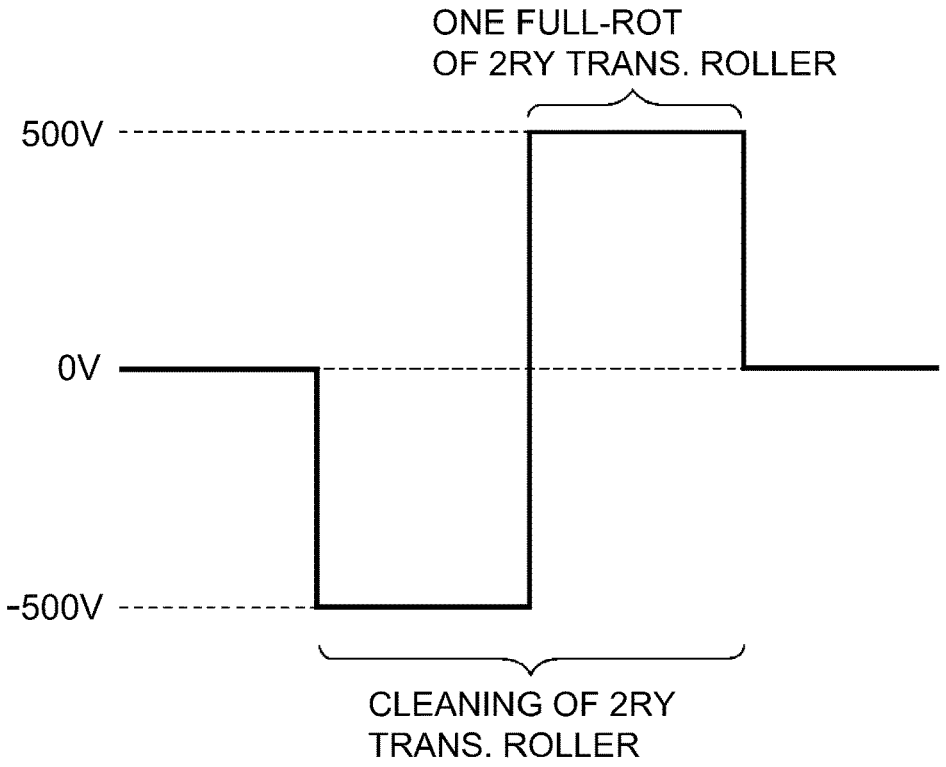
FIG. 2 is a chart for describing the operation for cleaning the secondary transfer roller of the image forming apparatus.

FIG. 2 is a chart of the operational sequence for applying voltage (which hereafter may be referred to as "cleaning voltage") to the secondary transfer roller 8 in the cleaning operation. In this embodiment, an operational sequence, in which DC voltage, which was the same in polarity as the normal toner charge, is applied for a preset length of time after a DC voltage, which is the same in polarity as the normal toner charge, is applied for a preset length of time, is referred to as a single unit of cleaning voltage application sequence. In this embodiment, the length of time the cleaning operation is carried out is changed by changing the number of times this unit of cleaning voltage application sequence is to be repeated, as will be described later.

In this embodiment, the abovementioned preset length of time is set to a value (0.025 second) which is equivalent to the length of time it takes for the secondary transfer roller 8 to rotate once. The DC voltage which is the same in polarity as the normal toner charge was −500 V. The DC voltage which is opposite in polarity from the normal toner charge was +500 V. By the way, the negative cleaning voltage and positive voltages may be different in absolute value. Further, they may be different in the length of time they are applied.

By applying both the positive and negative cleaning voltages, it is possible to move the toner particles on the secondary transfer roller 8, onto the intermediary transfer belt 7, whether the toner particles are positively charged or negatively charged. Therefore, it is possible to reduce the toner particles on the secondary transfer roller 8. Further, by applying both the positive and negative cleaning voltages, the toner particles on the secondary transfer roller 8 are made to vibrate by the switching in polarity of the cleaning voltage, being thereby made to more likely to move onto the intermediary transfer belt 7 than not.

3. Control of Length of Time Cleaning Operation is to be Carried Out

The operation for cleaning the secondary transfer roller 8 has to be carried out during a period in which a toner image to be transferred onto a sheet of transfer medium P is not moving through the secondary transferring portion N2 (during period in which image forming operation is not occurring in secondary transferring portion N2). For example, it is possible to temporarily interrupt an image forming operation while images are continuously formed, in order to apply the cleaning voltage to the secondary transfer roller 8 (interruptive cleaning operation). Further, it is possible to apply the cleaning voltage to the secondary transfer roller 8 after the completion of an image forming operation (post-rotation cleaning operation). Regardless of whether the interruptive cleaning operation is carried out or the post-rotation cleaning operation, there occurs temporarily a certain length of time in which the image forming operation cannot be carried out. Therefore, it is desired that the cleaning operation is carried out as briefly as possible while satisfactorily reducing the toner on the secondary transfer roller 8.

The studies made by the inventors of the present invention revealed that the amount by which toner accumulates on the peripheral surface of the secondary transfer roller 8 is affected by the type of a sheet of transfer medium P (which moves through secondary transferring portion N2), which is used for image formation. That is, the amount by which toner accumulates on the peripheral surface of the secondary transfer roller 8 is more when a smooth sheet of transfer medium P is used than when a less smooth sheet of transfer medium P is used, because the area of contact between a smooth sheet of transfer medium P and secondary transfer roller 8 is greater in size than the area of contact between a less smooth sheet of transfer medium P and secondary transfer roller 8. That is, the area of contact between a smooth sheet of transfer medium P and the secondary transfer roller 8 is greater in size than that between a less smooth sheet of transfer medium P and the secondary transfer roller 8. Therefore, when a smooth sheet of transfer medium P is used, the toner particles which adhered to the peripheral surface of the secondary transfer roller 8 are more likely to transfer onto the back surface of a sheet of transfer medium P while the sheet P moves through the secondary transferring portion N2 than when a less smooth sheet of transfer medium P is used. Therefore, the amount by which toner particles accumulate on the peripheral surface of the secondary transfer roller 8 when a smooth sheet of transfer medium P is used is less than that when a less smooth sheet of transfer medium P is used.

Figure 3:
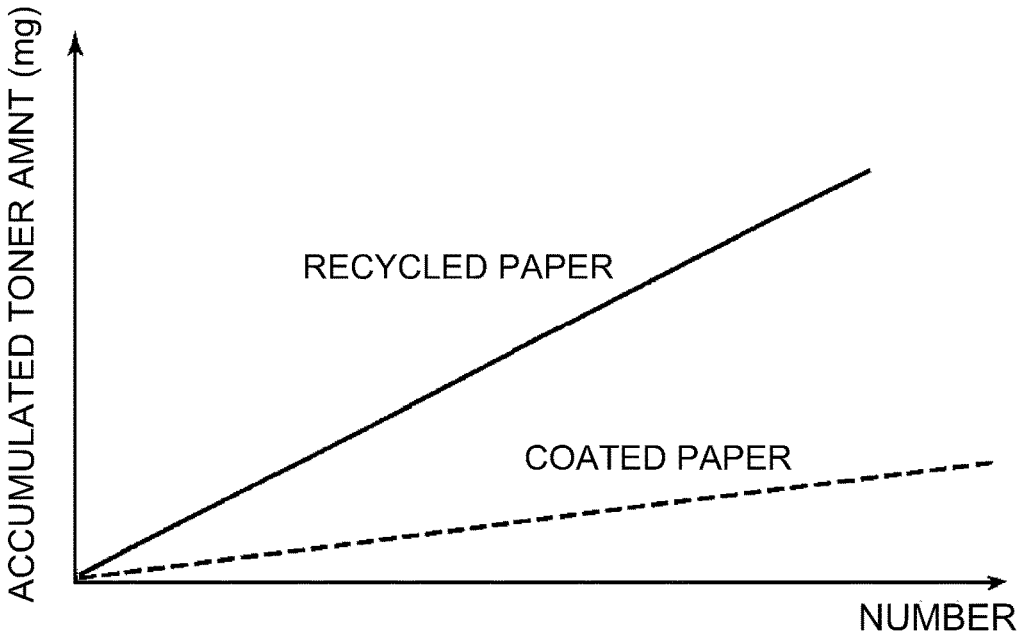
FIG. 3 is a graph for showing the relationship between the smoothness level of the surface of transfer medium and the amount by which toner accumulates on the surface of the transfer medium.

FIG. 3 shows the relationship among the number of images formed with the use of ordinary sheet of transfer medium P (ordinary paper or recycled paper), and the amount by which toner particles accumulated on the peripheral surface of the secondary transfer roller 8, when the cleaning operation was not carried out, and that when sheets P of coated paper was used. Coated paper is smoother than recycled paper. It is clear from FIG. 3 that the amount by which toner particles accumulate on the peripheral surface of the secondary transfer roller 8 when image formation is repeated is greater when coated paper is used as transfer medium than when recycled paper is used as transfer medium. That is, it is evident from FIG. 3 that coated paper which is smoother than recycled paper is more likely to cause the toner particles on the peripheral surface of the secondary transfer roller 8 to transfer onto its back surface (remove toner particles) when it is moved through the secondary transferring portion N2, than recycled paper which is less smooth than coated paper.

In this embodiment, therefore, the length of time the cleaning operation is to be carried per preset number of images formed is changed based on the information about the smoothness level of a sheet of transfer medium P to be used for image formation, that is, the information about how smooth a sheet of transfer medium P to be used for image formation is. In particular, in this embodiment, the length of time the cleaning operation is to be carried out per preset number of images formed is changed by changing the length of time by which the single unit of cleaning operation is carried out with preset timing. To describe in greater detail, in this embodiment, the length of time the cleaning operation is to be carried out is changed by changing the number of times (cleaning operation unit count) the single unit of cleaning voltage application sequence, shown in FIG. 2, is repeated. By the way, here, the image formation count (number by which images were formed) is increased by one each time a toner image is formed on one of the two surfaces of a sheet of transfer medium P. In a case where sheets of transfer medium P used for a given image forming operation are different in size from the standard one, the resultant count may be converted into the image formation count based on the standard size.

Figure 4:
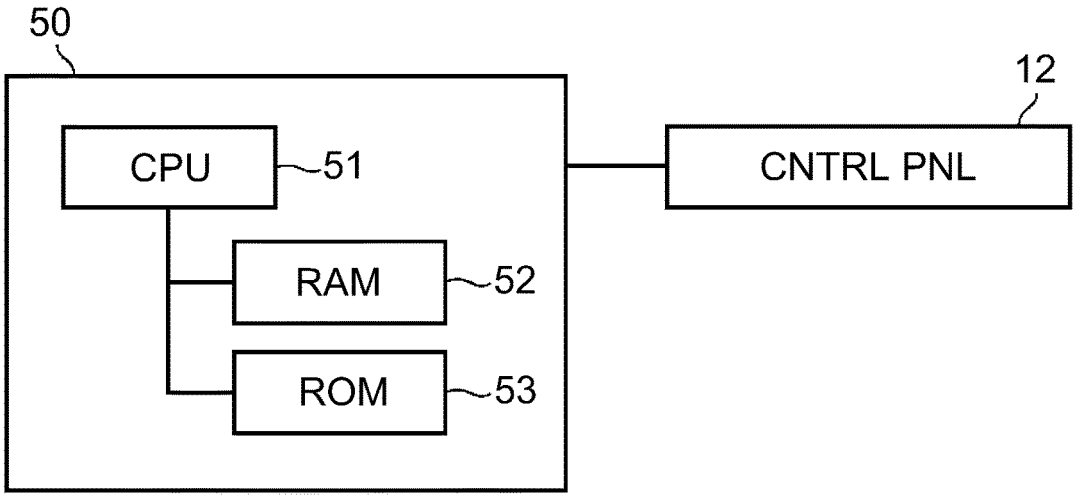
FIG. 4 is a block diagram of the essential portions of the control portion of the image forming apparatus in the first embodiment.

FIG. 4 is a block diagram of the essential portions of the control portion 50 of the image forming apparatus 100 in this embodiment. In this embodiment, the main assembly of the image forming apparatus 100 is provided with a control portion 50 (control circuit) as a controlling means. The operations of the various portions of the image forming apparatus 100 are integrally controlled by the control portion 50. The control portion 50 has a CPU 51 as a computing-controlling means. It has also a RAM 52, a ROM 53, and the like, as storing means. The CPU 51 controls the operations of various portions of the image forming apparatus 100, following the programs stored in the ROM 53, using the RAM 52 as an operational storage area, as necessary. The control portion 50 is in connection to a control panel 12, with which the main assembly of the image forming apparatus 100 is provided. The control panel 12 has: keys for inputting various settings, instructions, and the like; a display panel or the like, which is for displaying information for an operator such as a user, a service personnel, and the like. The control portion 50 controls the image forming operation in such a manner that images which are in accordance with image formation data (electrical information of image) inputted from external devices (unshown) such as a personal computer and an image reading apparatus, are formed on a sheet of transfer medium P, and outputted. Further, the control portion 50 controls the operation for cleaning the secondary transfer roller 8.

In this embodiment, the control portion 50 makes the image forming apparatus 100 carry out the cleaning operation for every preset number of images formed (every 200 images (prints), in this embodiment), regardless of the information about how smooth sheets of transfer medium P to be used are. It changes the length of time each cleaning operation is to be carried per preset image formation count (number of images formed), based on the information regarding the smoothness of the transfer medium P. To describe in greater detail, the control portion 50 changes the length of time the cleaning operation is to be carried out, by changing the number of times (cleaning count) the single unit of cleaning voltage application sequence is to be repeated, as described above.

In this embodiment, the information which shows the type of the transfer medium P to be used for printing is inputted by an operator through the control panel 12. The control portion 50 uses this information as the information regarding how smooth the transfer medium P to be used for printing is. That is, before a job is started, the type of the transfer medium P to be used for this job is selected by an operator with the use of the control panel 12. This information about the type of the selected transfer medium P is inputted, as the information regarding how smooth the transfer medium P to be used for the job is. In this embodiment, the control panel 12, which is the means for inputting the transfer medium type into the control portion 50, functions as the means for inputting the information regarding how smooth the transfer medium P to be used for the job, into the control portion 50. Further, in the ROM 53, such a table as Table 1 given below which shows the relationship between the transfer medium type and cleaning operation count is stored. The relationship is obtained in advance. The CPU 51 sets the number of times the cleaning operation is to be carried out in a given job, based on the table described above, that is, the inputted information regarding the type of the transfer medium P to be used for the job. Further, each time an image is formed, the CPU 51 cumulatively adds one to the value in the RAM 52, which functions as an image formation counter, and makes the RAM 52 store the sum. If the CPU 51 determines that the value of the cumulative image formation count N, which is stored in the RAM 52, reached a preset one, it makes the image forming apparatus carry out the cleaning operation by the count set through the process described above.

TABLE 1

| type | cleaning sequence count |
|---|---|
| high quality paper | 3 times |
| recycled paper | 4 times |
| coated paper | 1 time |
| emboss paper | 4 times |
| vellum paper | 2 times |

Figure 5:
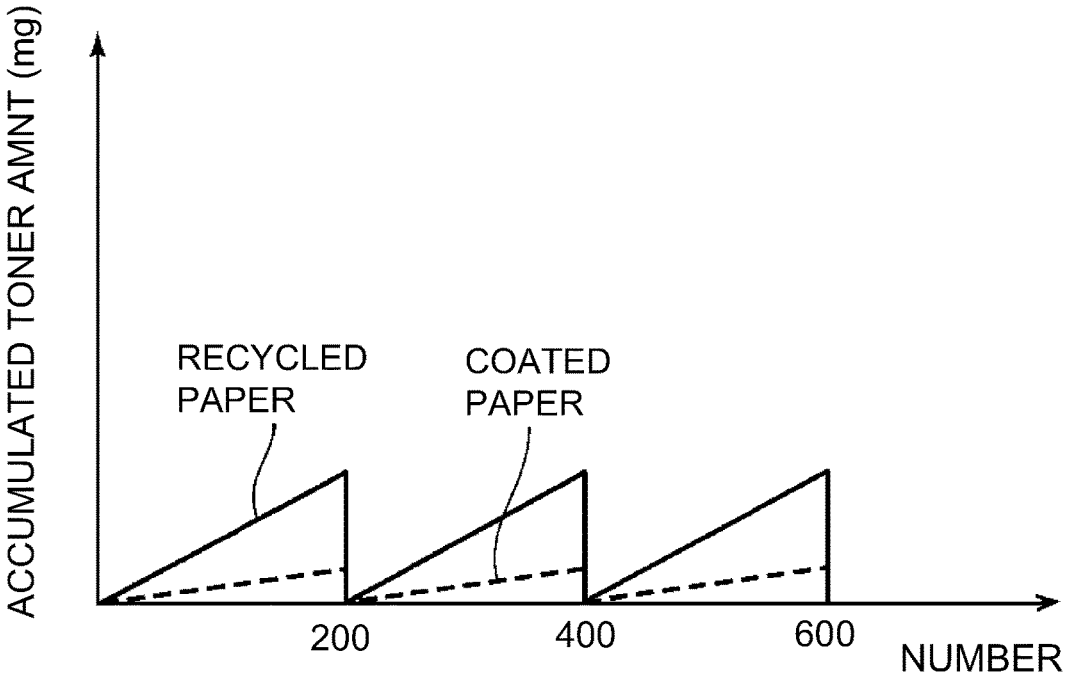
FIG. 5 is a graph which shows the changes in the amount by which toner accumulates on transfer medium; it is for showing the effects of the first embodiment.

FIG. 5 is similar to FIG. 3. It shows the relationship between the number by which images were formed and the amount by which toner particles accumulated on the peripheral surface of the secondary transfer roller 8, when the length of time the cleaning operation is carried out was changed according to how smooth the surface of the transfer medium P was, in this embodiment. It is evident from FIG. 5 that regardless of whether recycled paper was used or coated paper, the threshold value for the amount of the toner particles on the peripheral surface of the secondary transfer roller 8 was reset every 200th sheet. That is, it is evident that the cleaning operation was carried out as soon as possible, in accordance with how smooth the surface of the transfer medium P was, and yet, the toner particles on the secondary transfer roller 8 was sufficiently reduced regardless of which transfer medium P was used.

Figure 6:
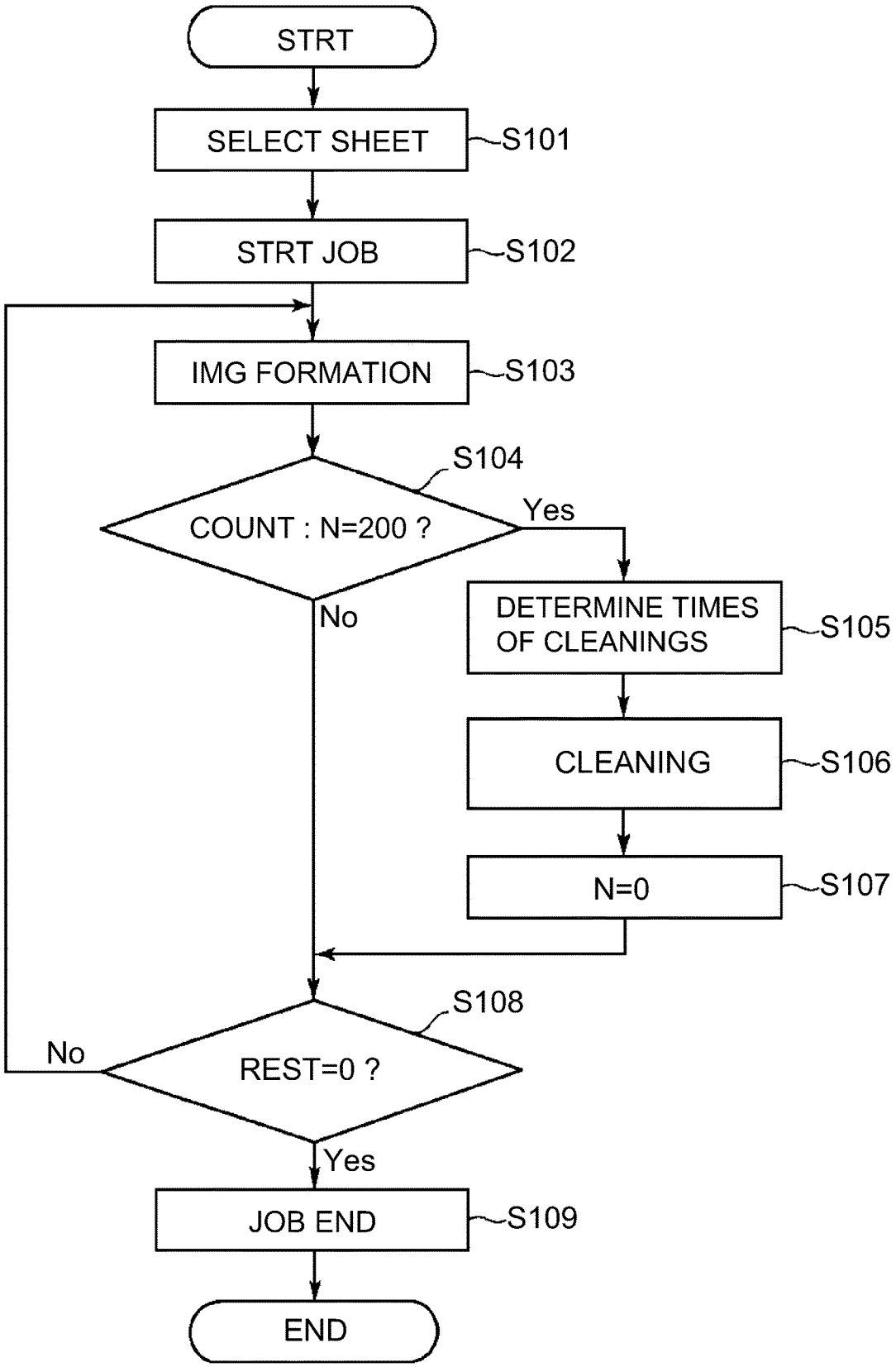
FIG. 6 is a flowchart of the control sequence in the first embodiment.

FIG. 6 is a flowchart of the control sequence through which the operation for cleaning the secondary transfer roller 8 was controlled in this embodiment. The type of the transfer medium P to be used for a given job is selected by an operator with the use of the control panel 12, before a given job is started. Then, the control portion 50 obtains this information, or the type of transfer medium P to be used for the job, as the information about how smooth the transfer medium P to be used for the job is (S101). Then, the control portion 50 makes the image forming apparatus 100 start the job (S102). Next, the control portion 50 makes the image forming apparatus 100 perform the image forming operation, and as each image is formed on a sheet of transfer medium P, it checks whether or not the cumulative count N of the images formed has reached a preset value (200, in this embodiment) (S104). If the control portion 50 determines, in S104, that the cumulative image formation count N reached the preset value, it determines and sets how many times the unit of cleaning sequence is to be repeated, based on the information about the transfer medium type obtained in S101 (S105). Then, the control portion 50 makes the image forming apparatus 100 perform the cleaning operation in which the single unit of cleaning sequence is repeated by the set (determined) number of times (S106). Further, each time the control portion 50 makes the image forming apparatus 100 perform a cleaning operation, it resets the cumulative image formation count N to an initial value (0, in this embodiment) (S107). Then, it determines whether or not the job requires more printing (S108). If it determines that there are more prints to be outputted, it makes the image forming apparatus 100 continue the printing operation (S103). If it determines that no print is left to be outputted, it makes the image forming apparatus 100 end the image forming operation (S109). Further, if it determines in S104 that the cumulative image formation count N has not reached the preset value, it makes the image forming apparatus 100 move to S108.

As described above, the image forming apparatus 100 in this embodiment has the control portion 50 which makes the image forming apparatus 100 perform the cleaning operation for removing the toner particles on the secondary transfer roller 8 by applying voltage to the secondary transfer roller 8 with the use of the secondary transfer power source 10. This cleaning operation is an operation which alternately applies such voltage that is the same in polarity as the normal toner charge, for a preset length of time, and such voltage that is opposite in polarity from the normal toner charge, for a preset length of time. Further, the image forming apparatus 100 has the inputting means for inputting into the control portion 50, the information which shows how smooth the surface of the transfer medium P, which is being conveyed to the secondary transferring portion N2, is. In this embodiment, this inputting means is the inputting portion (control panel) which is enabled to accept the information which shows the type of the transfer medium P, and input the accepted information which shows the type of the transfer medium P, into the control portion 50, as the information which shows how smooth the transfer medium P is. The control portion 50 changes the length of time the cleaning operation is to be carried out per preset image formation count N, based on the information inputted by the inputting means about how smooth the transfer medium P is. In this embodiment, not only does the control portion 50 make the image forming apparatus 100 perform the cleaning operation during the periods which correspond to paper interval periods in a job, or during the post-rotation period, but also, it changes the length of time the cleaning operation is to be performed in each job, based on the information about how smooth the transfer medium P, which is being conveyed to the secondary transferring portion N2, is. By the way, the paper interval period is the period between right after a sheet of transfer medium P comes out of the secondary transferring portion N2 and when the following sheet of transfer medium P reaches the secondary transferring portion N2. The post-rotation period is the period which comes immediately after the last sheet of transfer medium P, onto which a toner image is to be transferred in a job, comes out of the secondary transferring portion N2. In this embodiment, the control portion 50 sets shorter, the length of time the cleaning operation is to be carried out when the smoothness level which the smoothness level information indicates is the second one which is higher than the first one, than that when the smoothness level information is the first one.

In other words, the image forming apparatus 100 has the control portion 50 which makes the image forming apparatus 100 perform the cleaning operation for removing the toner particles on the peripheral surface of the secondary transfer roller 8 by applying voltage to the secondary transfer roller 8 with the use of the secondary transfer power source 10, during sheet interval periods in a continuous job. A continuous job is such a job that is started in response to a start command to form multiple images on multiple sheets of transfer medium P, one for one, and output the sheets. Further, the sheet interval period is a period between right after a sheet of transfer medium P comes out of the secondary transferring portion N2, and when the following sheet of transfer medium P reaches the secondary transferring portion N2. Further, the cleaning operation is an operation for alternately applying to the secondary transfer roller 8, such voltage that is the same in polarity as the normal toner charge, for a preset length of time, and also, such a voltage that is opposite in polarity from the normal toner charge for a preset length of time. Here, a job which uses only sheets of the first transfer medium P (coated sheet, for example) having the first level of smoothness, is referred to as the first continuous job, and a job which uses only sheets of second transfer medium P (ordinary paper, recycled paper, for example) having the second level of smoothness which is lower than the first level of smoothness is referred to as the second continuous job. In this embodiment, in a case where a continuous job is carried out in a preset environment, the length of time the cleaning operation is carried out during the first sheet interval period in the first continuous job is the first length of time. The length of time the cleaning operation is carried out during the first sheet interval period in the second continuous job is the second length of time, which is longer than the first length of time. By the way, the reason why the two are compared under practically the same environments is that there are cases where the length of time the cleaning operation has to be carried out has to be changed according to the environmental factors, as will be described later. Further, typically, the environmental factor is at least one of the temperature or humidity of the interior or exterior of the image forming apparatus 100.

As described above, in this embodiment, the length of time the cleaning operation for cleaning the secondary transfer roller 8 is carried out is changed based on the information which shows the type of the transfer medium P which is to be used for a printing operation. Thus, not only is it possible to satisfactorily prevent toner particles from accumulating on the peripheral surface of the secondary transfer roller 8 by an amount greater than a critical one, but also, to prevent the problem that the cleaning operation is carried out longer than necessary, in order to prevent the image forming apparatus 100 from being reduced in productivity.

[Embodiment 2]

Next, another embodiment of the present invention is described. The image forming apparatus in this embodiment is the same as the image forming apparatus in the first embodiment, in basic structure and operation. Therefore, the elements of the image forming apparatus in this embodiment, which are the same as, or equivalent to, the counterparts of the image forming apparatus in the first embodiment, in function or structure, are given the same referential codes as those given to the counterparts, one for one, and are not described in detail.

Also in this embodiment, the length of time the cleaning operation for cleaning the secondary transfer roller 8 is to be carried out is changed based on the information about the smoothness level of the transfer medium P which is to be used for a printing operation. In this embodiment, however, the control portion 50 detects the level of smoothness of the transfer medium P to be used for a printing operation, with the use of a smoothness level detecting means, and uses the detected smoothness level of the transfer medium P as the smoothness level information.

Figure 7:
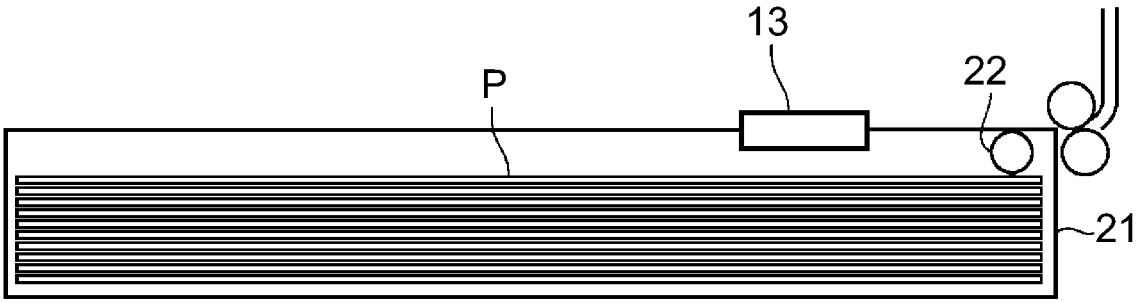
FIG. 7 is a schematic sectional view of a part of the image forming apparatus; it is for describing the smoothness sensor.
Figure 8:
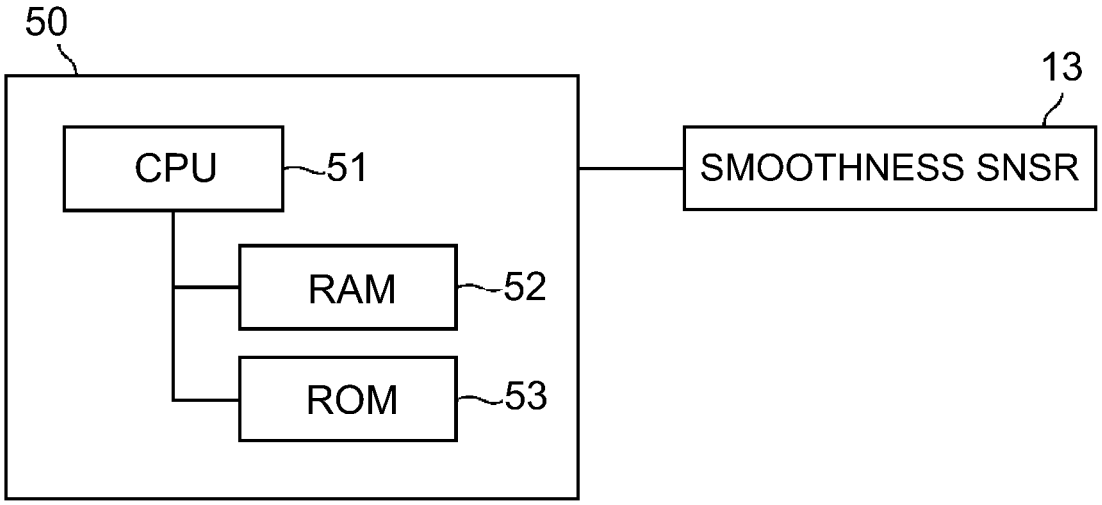
FIG. 8 is a block diagram of the essential portions of the control portion of the image forming apparatus.

FIG. 7 is a schematic sectional view of the cassette 21 of the image forming apparatus 100 in this embodiment, and its adjacencies. FIG. 8 is a block diagram of the essential portions of the control portion 50 of the image forming apparatus 100 in this embodiment. In this embodiment, the image forming apparatus 100 has a smoothness level sensor 13, as a smoothness level sensing means, for detecting the smoothness level of the surface of the transfer medium P stored in the cassette 21. The smoothness level sensor 13 has: an LED as a light emitting element; and a MOS image sensor as a light sensing element. It is structured so that a beam of light emitted by its light emitting portion is reflected by the surface of the transfer medium P in the cassette 21, and the reflected light is caught by its light sensing element. The result of detection by the smoothness level sensor 13, that is, the value of the signal which shows the strength of the beam of light caught by the light sensing element, is inputted into the control portion 50, as the information about the level of smoothness of the transfer medium P to be used for a job. That is, in this embodiment, the smoothness level sensor 13 functions as a smoothness level inputting means for inputting the smoothness level information into the control portion 50. Further, in the ROM 53, a table such as the following Table 2, which was obtained in advance and shows the relationship between the results (signal values) of detection by the smoothness level sensor 13 and the number of times the cleaning operation is to be carried out, is stored. The CPU 51 determines the number of times the cleaning operation is to be carried out, based on the detected level of smoothness of the surface of the transfer medium P used for an inputted job, with reference to the abovementioned table. Further, as the value of the cumulative image formation count N stored in the RAM 52 reaches a preset value (200 in this embodiment), the CPU 51 makes the image forming apparatus perform the cleaning operation by the determined number of times.

TABLE 2

| signal value | cleaning sequence count |
|---|---|
| 0~50 | 4 times |
| 50~100 | 3 times |
| 100~150 | 2 times |
| 150~255 | 1 time |

Figure 9:
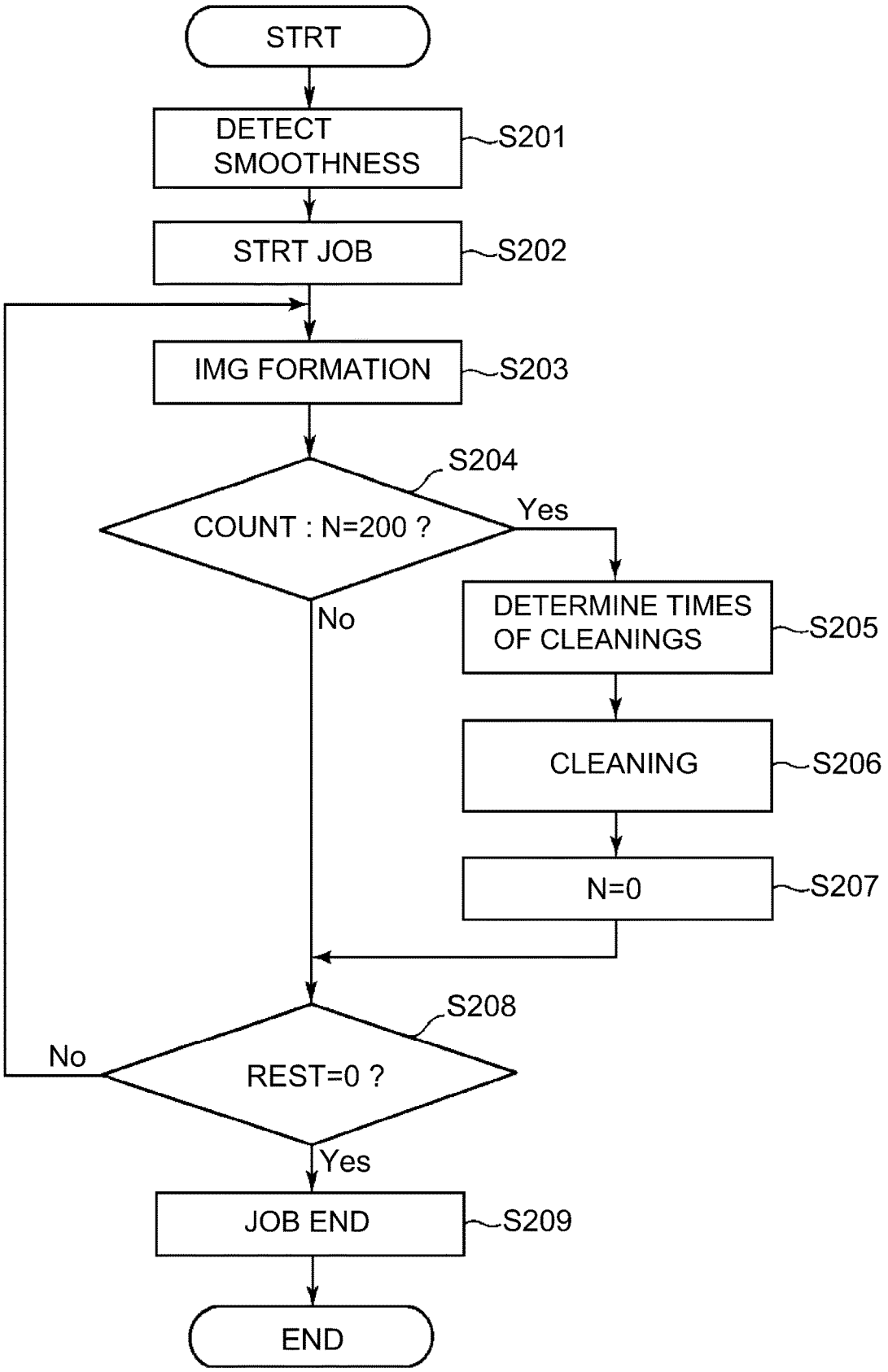
FIG. 9 is a flowchart of the control sequence in the second embodiment of the present invention.

FIG. 9 is a flow chart of the control sequence of the cleaning operation for cleaning the secondary transfer roller 8. The processes carried out in S202-S209 in FIG. 9 are the same as those in S102-S109 in FIG. 6, and therefore, are not described in detail. In this embodiment, the control portion 50 obtains, in S201, the results of the detection by the smoothness level sensor 13, as the information about the smoothness level of the transfer medium P used for a given job. Also in this embodiment, the control portion 50 determines and sets in S205 the number of times the cleaning operation is to be carried out, based on the results of the detection by the smoothness level sensor 13, obtained in S201, with reference to the information shown in Table 2.

As described above, in this embodiment, the inputting means for inputting the smoothness level information into the control portion 50 is the smoothness level detecting means 13 (smoothness level sensor), which detects the smoothness level of the transfer medium P to be conveyed to the secondary transferring portion N2, and inputs the results of the detection into the control portion 50, as the smoothness level information.

As described above, in this embodiment, the length of time the cleaning operation for cleaning the secondary transfer roller 8 is to be carried out is changed based on the results of the detection of the smoothness level of the surface of the transfer medium P to be used for the printing operation. Therefore, not only is it possible to obtain the results similar to those obtainable by the image forming apparatus 100 in the first embodiment, but also, to automatically obtain the information about the smoothness level of the transfer medium P. Therefore, it is possible to reduce the work load to which an operator is subjected.

[Embodiment 3]

Next, another embodiment of the present invention is described. The image forming apparatus in this embodiment is the same as the image forming apparatus in the first embodiment, in basic structure and operation. Therefore, the elements of the image forming apparatus in this embodiment, which are the same as, or equivalent to, the counterparts of the image forming apparatus in the first embodiment, in function or structure, are given the same referential codes as those given to the counterparts, one for one, and are not described in detail.

In this embodiment, the image forming apparatus 100 can form images, with the peripheral velocity of its intermediary transfer belt 7 set to one of two values, more specifically, 250 (mm/sec) and 125 (mm/sec). More concretely, the image forming apparatus 100 is designed so that its control portion 50 is enabled to control the rotational speed of the motor which drives the intermediary transfer belt 7, in order to enable the intermediary transfer belt 7 to be rotationally driven at one of the preset two speeds. The peripheral velocity of the intermediary transfer belt 7 is switched according to the thickness of the transfer medium P, and/or the condition of the environment in which the image forming apparatus 100 is set up.

The studies made by the inventors of the present invention revealed that the amount by which toner particles accumulate on the peripheral surface of the secondary transfer roller 8 is affected by the speed with which the transfer medium P is conveyed through the secondary transferring portion N2. That is, the amount by which toner particles accumulate on the peripheral surface of the secondary transfer roller 8 when the speed with which the transfer medium P is conveyed is higher, is greater than that when the speed with which the transfer medium P is conveyed is slow. This is attributable to the fact that the length of time a unit length of the transfer medium P in terms of the transfer medium conveyance direction remains in contact with the peripheral surface of the secondary transfer roller 8 is longer when the transfer medium conveyance speed is slow than that when the transfer medium conveyance speed is high. That is, it is more likely for the toner particles on the peripheral surface of the secondary transfer roller 8 to transfer onto the back surface of the transfer medium P (to be removed) while the transfer medium P moves through the secondary transferring portion N2, when the speed with which the transfer medium P is conveyed is slow. Therefore, the amount by which toner particles accumulate on the peripheral surface of the secondary transfer roller 8 is smaller when the transfer medium conveyance speed is slow than when the transfer medium conveyance speed is high.

Figure 10:
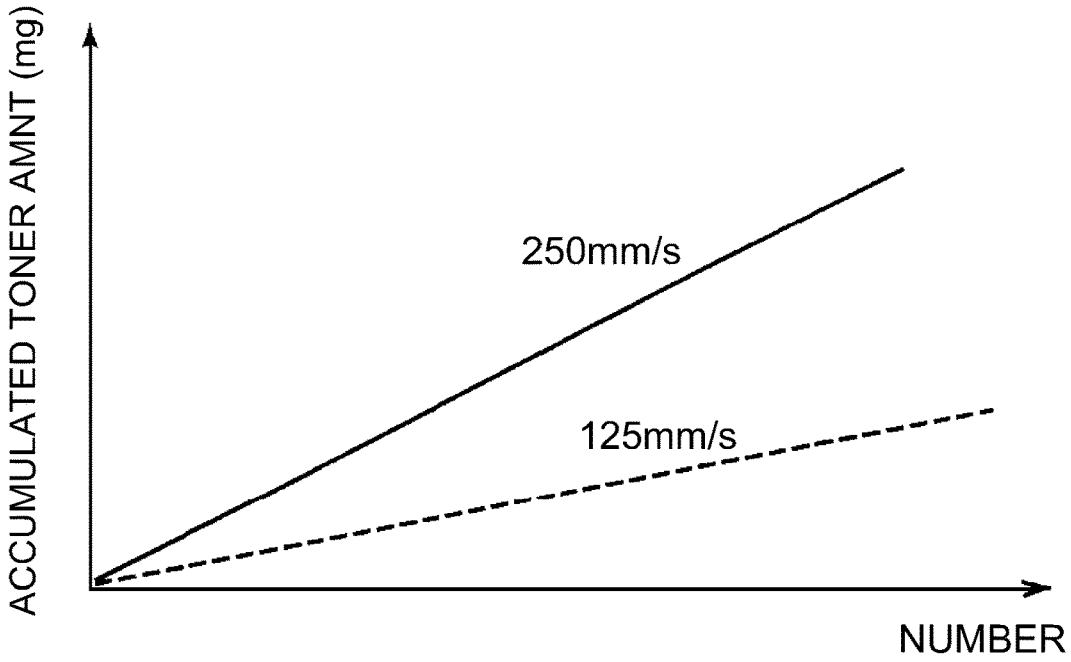
FIG. 10 is a graph which shows the relationship between the speed with which transfer medium is conveyed, and the amount by which toner accumulates on the transfer medium.

FIG. 10 shows the relationship between the image formation count (number by which images have been formed) and the amount by which toner particles accumulated on the peripheral surface of the secondary transfer roller 8, when the cleaning operation was not carried out. It shows also the results of the comparison in the relationship between when the transfer medium conveyance speed was 250 (mm/sec) and when it was 125 (mm/sec). It is evident from FIG. 10 that the amount by which toner particles accumulate on the peripheral surface of the secondary transfer roller 8 as an image forming operation is repeated is clearly smaller when the transfer medium conveyance speed is slow than when it is higher. That is, it is evident that it is easier to remove the toner particles on the peripheral surface of the secondary transfer roller 8 by transferring the toner particles onto the back surface of the transfer medium P while the transfer medium P is conveyed through the secondary transferring portion N2, when the transfer medium conveyance speed is slow than when it is high.

In this embodiment, therefore, the length of time the cleaning operation is to be carried out per preset number (count) of images formed is changed, based on the peripheral velocity of the intermediary transfer belt 7, that is, the speed with which the transfer medium P is conveyed through the secondary transferring portion N2. In particular, in this embodiment, the length of time the cleaning operation is carried out per preset number (count) of images formed is changed by changing the length of time the cleaning operation is carried out with a given timing. To describe in greater detail, in this embodiment, the length of time the cleaning operation is to be carried out is changed by changing the number of times the single unit of cleaning voltage application sequence is repeated. By the way, in this embodiment, the cleaning operation itself is not changed regardless of the speed with which the transfer medium P is conveyed through the secondary transferring portion N2. It is carried out for every preset image formation count (200 in this embodiment). In this embodiment, the length of time the cleaning operation is carried out for every preset image formation count is changed based on the speed with which the transfer medium P is conveyed through the secondary transferring portion N2, as in the first embodiment.

The manner in which the essential portions of the image forming apparatus 100 in this embodiment are controlled is the same as that in the first embodiment, as shown in FIG. 4. As the control portion 50 makes the image forming apparatus 100 start a job, it sets a peripheral velocity at which the intermediary transfer belt 7 is to be driven for the job, according to environmental factors (temperature, humidity, and the like). Then, it makes the RAM 52 store the information which shows the set peripheral velocity for the intermediary transfer belt 7. Further, a table such as the following Table 3 which shows the relationship between the peripheral velocity of the intermediary transfer belt 7 and the number by which the cleaning operation is to be carried out is obtained in advance, and is stored in the ROM 53, as shown in the following Table 3. The CPU 51 sets the number of times the cleaning operation is to be carried out in the given job, from the information which shows the peripheral velocity of the intermediary transfer belt 7 (speed with which transfer medium P is conveyed through secondary transferring portion N2) in the job, and is stored in the RAM 52. Further, as the value of the cumulative image formation count N (stored in RAM 52) reaches a preset value (200 in this embodiment), the CPU 51 makes the image forming apparatus 100 carry out the cleaning operation by the aforementioned set number of times, as in the first embodiment.

TABLE 3

| Peripheral velocity | cleaning sequence count |
|---|---|
| 125 mm/s | 1 time |
| 250 mm/s | 2 times |

Figure 11:
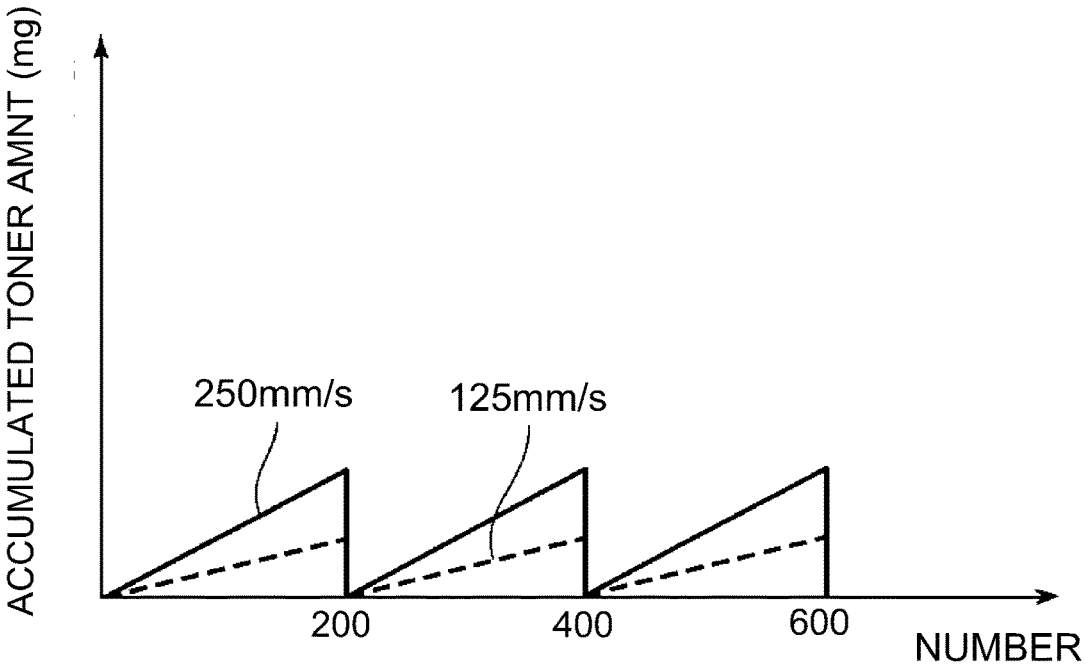
FIG. 11 is a graph which shows the changes in the amount by which toner accumulates on transfer medium; it is for describing the effects of the third embodiment.

FIG. 11 shows the relationship between the image formation count and the amount by which toner particles accumulated on the peripheral surface of the secondary transfer roller 8 when the length of time the cleaning operation is carried out was changed based on the peripheral velocity of the intermediary transfer belt 7 (speed with which transfer medium P is conveyed through secondary transferring portion N2), according to this embodiment. It is evident from FIG. 11 that the threshold value for the amount by which toner particles accumulated on the peripheral surface of the secondary transfer roller 8 was reset for every 200th print, regardless of transfer medium conveyance speed. That is, it is evident that this embodiment also can sufficiently reduce the toner on the peripheral surface of the secondary transfer roller 8, regardless of the transfer medium P conveyance speed, in as short a length of time as possible, according to the speed with which the transfer medium P is conveyed through the secondary transferring portion N2.

Figure 12:
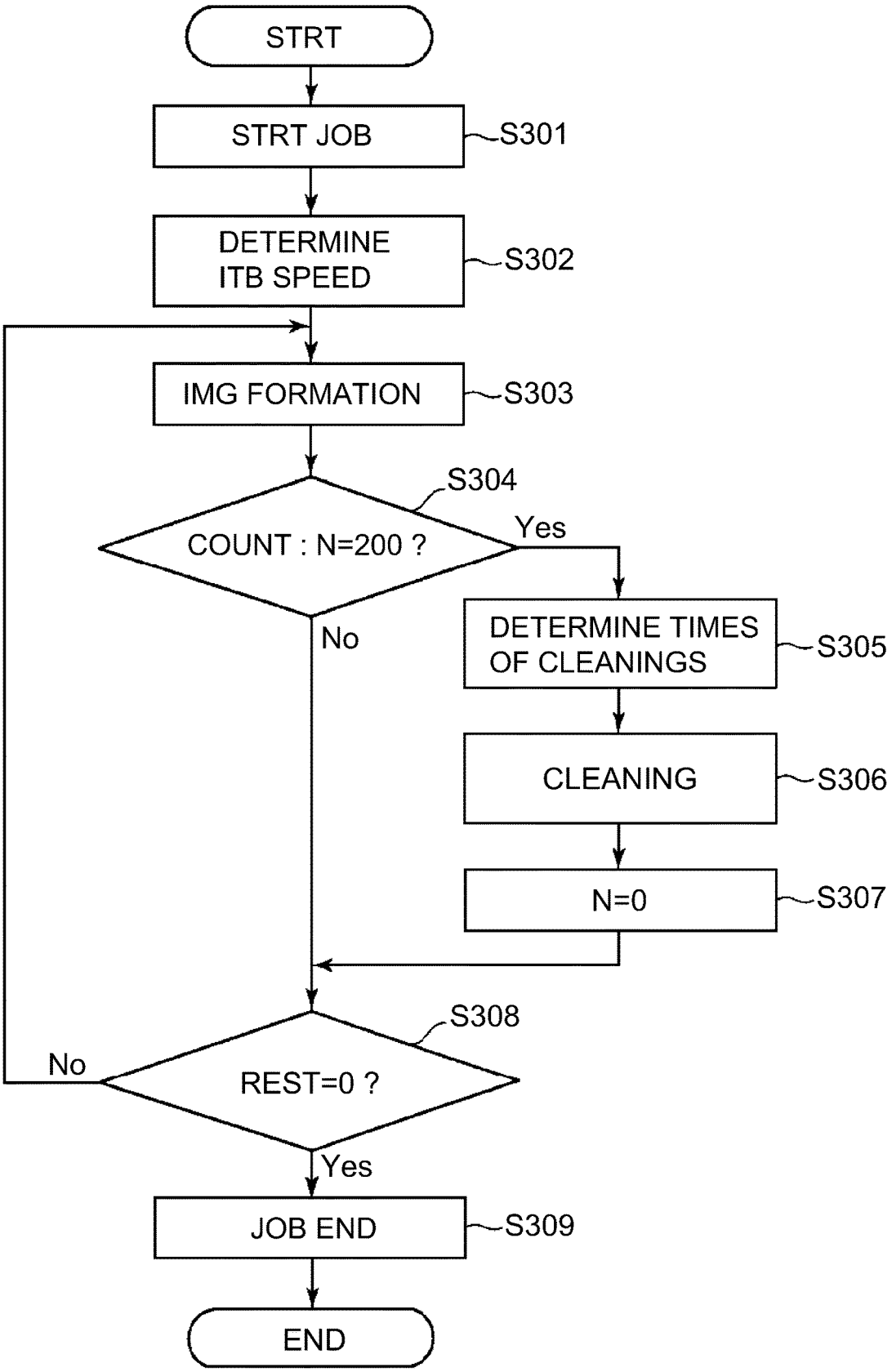
FIG. 12 is a flow chart of the control sequence in the third embodiment.

FIG. 12 is a flowchart of the control sequence, in this embodiment, for the cleaning operation for cleaning the secondary transfer roller 8. As the control portion 50 makes the image forming apparatus 100 start a given job (S301), it sets peripheral velocity for the intermediary transfer belt 7 (S302). The processes carried out in S303-S309, shown in FIG. 12, according to this embodiment are similar to those carried out in S103-S109, shown in FIG. 6, in the first embodiment, and therefore, are not described in detail. In this embodiment, however, the control portion 50 sets the number of times the cleaning operation is to be carried out, based on the peripheral velocity (speed with which transfer medium P is conveyed through secondary transferring portion N2) set for intermediary transfer belt 7 in S302, with reference to the information given in the aforementioned Table 3.

As described above, in this embodiment, the control portion 50 changes the length of time the cleaning operation is to be carried out per preset number (unit) of outputted images (prints), based on the speed with which the transfer medium P is conveyed through the secondary transferring portion N2. In this embodiment, not only does the control portion 50 make the image forming apparatus 100 carry out the cleaning operation during the sheet interval period, or post-rotation period, but also, it changes the length of time the cleaning operation is to be carried out, based on the speed with which the transfer medium P is conveyed through the secondary transferring portion N2 in the given job. In this embodiment, the length of time the cleaning operation is to be carried out when the speed with which the transfer medium P is conveyed is the second speed which is slower than the first speed, is made shorter than that when the speed with which the transfer medium P is conveyed is the first one.

In this embodiment, the length of time the operation for cleaning the secondary transfer roller 8 is to be carried out is changed, based on the speed with which the transfer medium P is conveyed through the secondary transferring portion N2, as described above. Therefore, it is possible to prevent the cleaning operation from being carried out longer than necessary, while sufficiently reducing the toner particles on the peripheral surface of the secondary transfer roller 8. Therefore, it is possible to prevent the image forming apparatus 100 from being unnecessarily reduced in productivity by the cleaning operation.

[Embodiment 4]

Next, another embodiment of the present invention is described. The basic structure and operation of the image forming apparatus in this embodiment are the same as those of the image forming apparatus in the first embodiment. Therefore, the elements of the image forming apparatus in this embodiment, which are the same as, or equivalent to, the counterparts of the image forming apparatus in the first embodiment, in function or structure, are given the same referential codes as those given to the counterparts, one for one, and are not described in detail.

In this embodiment, not only the length of time the cleaning operation is to be carried out is changed based on the information about the smoothness level of the transfer medium P to be used for a printing operation, as in the first embodiment, but also, it is changed based on the speed with which the transfer medium P is conveyed through the secondary transferring portion N2, as in the third embodiment.

The manner in which the essential portions of the image forming apparatus 100 in this embodiment are controlled is similar to the one in which the image forming apparatus 100 was controlled in the first embodiment, as shown in FIG. 4. In this embodiment, a table such as the following Table 4, which shows the information about the relationship among the type of transfer medium P, the peripheral velocity of the intermediary transfer belt 7, and the number of times the cleaning operation is to be carried out, is obtained in advance, and is stored in the ROM 53. The CPU 51 sets the number of times the cleaning operation is to be carried out, based on the information about the type of the transfer medium P to be used for the job, as in the first embodiment, and the peripheral velocity set for the intermediary transfer belt 7 for the job, as in the third embodiment, with reference to the aforementioned table. Further, the CPU 51 makes the image forming apparatus 100 carry out the cleaning operation by the number of times set as described above; as the value, stored in the RAM 52, for the cumulative image formation count N reaches a preset value (200 in this embodiment), the CPU 51 makes the image forming apparatus 100 carry out the cleaning operation by the number of times set as described.

TABLE 4

| Type | Peripheral velocity | cleaning sequence count |
|---|---|---|
| high quality paper | 125 mm/s | 2 times |
| | 250 mm/s | 3 times |
| recycled paper | 125 mm/s | 2 times |
| | 250 mm/s | 4 times |
| coated paper | 125 mm/s | 1 time |
| | 250 mm/s | 1 time |
| embossable paper | 125 mm/s | 2 times |
| | 250 mm/s | 4 times |
| vellum paper | 125 mm/s | 1 time |
| | 250 mm/s | 2 times |

Figure 13:
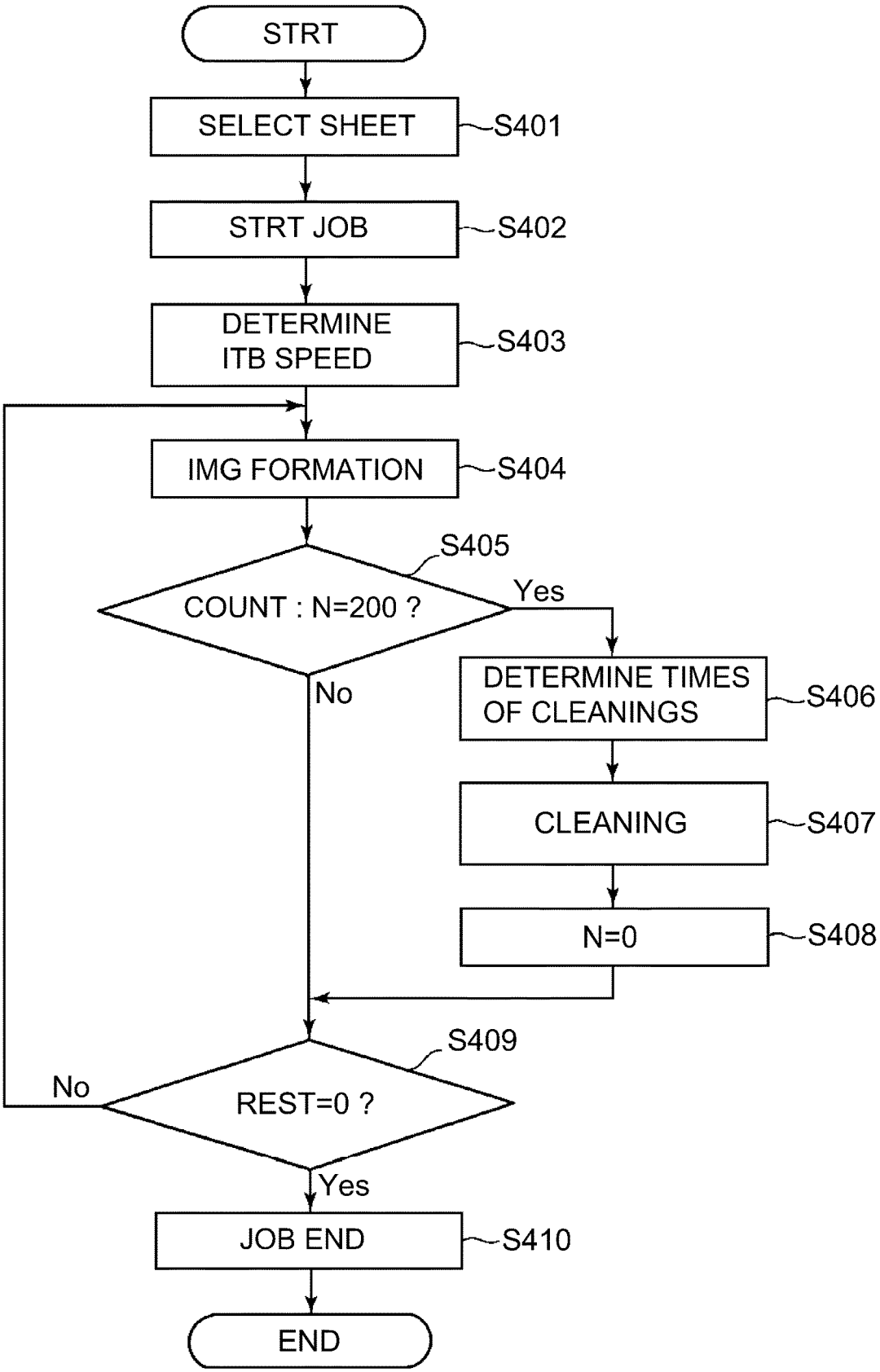
FIG. 13 is a flowchart of the control sequence in the fourth embodiment.

FIG. 13 is a flowchart of the control sequence of the operation for cleaning the secondary transfer roller 8, in this embodiment. The control portion 50 obtains the information about the type of the transfer medium P selected, through the control panel 12, by an operator to be used for a given job, as the information about the smoothness level of the transfer medium P, before it makes the image forming apparatus 100 start the job (S401). Next, the control portion 50 makes the image forming apparatus 100 start the job (S402), and sets a peripheral velocity for the intermediary transfer belt 7, for the job (S403). The processes to be carried out in S404-S410 in FIG. 13 are the same as those to be carried out in S103-S109 in FIG. 6, and therefore, are not described in detail. In this embodiment, however, the control portion 50 sets, in S406, the number of times the cleaning operation is to be carried out, based on the information obtained in S401 about the type of the transfer medium P with reference to the information shown in the abovementioned Table 4, and the peripheral velocity set for the intermediary transfer belt 7 in S403.

By the way, also in this embodiment, the results of the detection by the smoothness level sensor 13 may be used as the smoothness level information as in the second embodiment.

In this embodiment, the control portion 50 changes the length of time the cleaning operation is to be carried out per preset number (unit) of images formed, based on the smoothness level information, and the speed with which the transfer medium P is conveyed through the secondary transferring portion N2, as described above. Further, in this embodiment, the control portion 50 makes the image forming apparatus 100 carry out the cleaning operation during the sheet interval period or post-rotation period, in each job. Moreover, the control portion 50 changes the length of time the cleaning operation is to be carried out in the job, based on the information about the smoothness level of the transfer medium P to be conveyed to the secondary transferring portion N2 in the job, and the speed with which the transfer medium P is conveyed through the secondary transferring portion N2 in the job. In this embodiment, the control portion 50 makes the length of time the cleaning operation is to be carried out, shorter when the smoothness level which the smoothness level information indicates is the second one which is higher than the first one, than when it is the first one. Further, if the transfer media P are the same in smoothness level, the control portion 50 makes shorter, the length of time the cleaning operation is to be carried out when the transfer medium conveyance speed is the second one which is slower than the first one, than when the transfer medium conveyance speed is the first one.

In this embodiment, the control portion 50 changes the length of time the operation for cleaning the secondary transfer roller 8 is to be carried out, based on the type of the transfer medium P to be used for a printing operation, and the speed with which the transfer medium P is conveyed through the secondary transferring portion N2, as described above. Therefore, effects similar to those obtainable in the first and third embodiments can be obtained at a higher level.

[Embodiment 5]

Next, another embodiment of the present invention is described. The basic structure and operation of the image forming apparatus in this embodiment are the same as those of the image forming apparatus in the first embodiment. Therefore, the elements of the image forming apparatus in this embodiment, which are the same as, or equivalent to, the counterparts of the image forming apparatus in the first embodiment, in function or structure, are given the same referential codes as those given to the counterparts, one for one, and are not described in detail.

In this embodiment, the operation for cleaning the secondary transfer roller 8 is carried out between when a job is started and when an image begins to be actually formed in the job, that is, during the pre-rotation period.

It is desired, even in a case where the cleaning operation is carried out during the pre-rotation period, that the length of time the cleaning operation is carried out is to be kept as short as possible as the interruptive cleaning operation and post-rotation cleaning operation described as parts of the description of the first embodiment.

In a case where the cleaning operation is carried out during the pre-rotation period, it is desired that the length of time the cleaning operation is to be carried out is changed based on the information about the smoothness level of the transfer medium P used in the immediately prior job, because the amount of the toner which is on the peripheral surface of the secondary transfer roller 8 when a job is started was affected by the smoothness level of the surface of the transfer medium P used in the prior job. More concretely, it is desired that the length of time the cleaning operation is to be carried out when the surface of the transfer medium P used in the prior job was high in smoothness level is made shorter than when the transfer medium P was low in smoothness level.

On the other hand, in a case where the cleaning operation is carried out during the pre-rotation period, the information about the transfer medium P to be used in the current job is known. Therefore, it is desired that the length of time the cleaning operation is to be carried out is changed based on the information about the smoothness level of the transfer medium P to be used in the current job, as well. More concretely, it is desired that the length of time the cleaning operation to be carried when the surface of the transfer medium P to be used in the current job is low in smoothness level is made shorter than that when the transfer medium P to be used in the job is high in smoothness level, because, in a case where the transfer medium P to be used in the job is high in smoothness level, the toner having accumulated on the surface of the secondary transfer roller 8 during the preceding job is less likely to transfer onto the back surface of the transfer medium P than when the surface of the transfer medium P is high in smoothness level, and therefore, it is less likely for the back surface of the transfer medium P to be soiled.

In this embodiment, therefore, the length of time the operation for cleaning the secondary transfer roller 8 during the pre-rotation period is changed based on both the information about the smoothness level of the transfer medium P used in the immediately preceding job, and the information about the smoothness level of the transfer medium P used in the current job. In particular, in this embodiment, the length of time the cleaning operation is to be carried out per preset (unit) number of image formation count, is changed by the change in the length of time the cleaning operation is to be carried out with given timing, as in the first embodiment. To described in greater detail, in this embodiment, the length of time the cleaning operation is to be carried out is changed by the change in the number of times a single cleaning voltage application sequence, shown in FIG. 2, is repeated, as in the first embodiment.

The manner in which the essential portions of the control portion 50 of the image forming apparatus 100 are controlled is the same as that in the first embodiment, which is shown in FIG. 4. In this embodiment, the control portion 50 obtains the information which is inputted by an operator through the control panel 12 and shows the type of the transfer medium P to be used for the printing job, as the information which shows the smoothness level of the surface of the transfer medium P to be used for the printing job, as in the first embodiment. That is, before the starting of a job, the type of the transfer medium P to be used for the printing job is selected by an operator with the use of the control panel 12. This information which shows the type of the transfer medium P to be used for the job is inputted into the control portion 50. Further, in this embodiment, the information which shows the type of the transfer medium P used in the immediately preceding job is stored in the RAM 52. Further, the relationship, as information, among the type of the transfer medium P used for the preceding job, the type of the transfer medium P to be used for the current job, and the number of times the cleaning operation is to be carried out, is obtained in advance and is stored in the form of a table, such as the following Table 5, in the ROM 53. The control portion 50 sets the number of times the cleaning operation is to be carried out in the current job, based on the aforementioned inputted information which shows the type of the transfer medium P to be used for the current job, and the information which is stored in the RAM 52 and shows the type of the transfer medium P used in the preceding job, with reference to the abovementioned table. Further, the CPU 51 makes the image forming apparatus 100 carry out the cleaning operation by the set number of times as the cumulative image formation count N stored in the RAM 52 reaches a preset value (200 in this embodiment), as in the first embodiment.

TABLE 5

| preceding job | current job | cleaning sequence count |
|---|---|---|
| high quality paper | high quality paper, coated paper, vellum paper | 3 times |
| | recycled paper, embossable paper | 1 time |
| recycled paper | high quality paper, coated paper, vellum paper | 4 times |
| | recycled paper, embossable paper | 2 times |
| coated paper | high quality paper, coated paper, vellum paper | 1 time |
| | recycled paper, embossable paper | 1 time |
| embossable paper | high quality paper, coated paper, vellum paper | 4 times |
| | recycled paper, embossable paper | 2 times |
| vellum paper | high quality paper, coated paper, vellum paper | 2 times |
| | recycled paper, embossable paper | 1 time |

Figure 14:
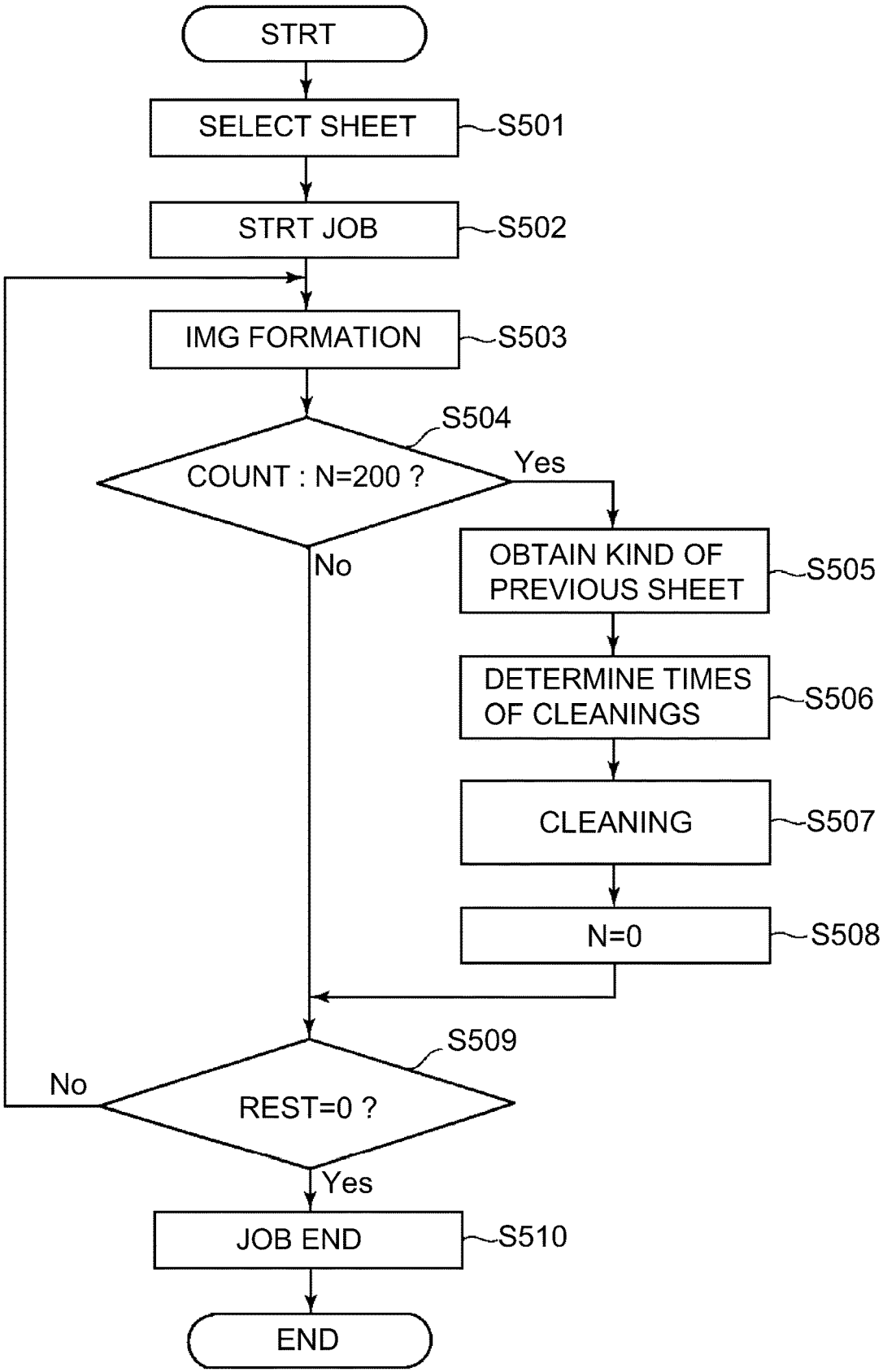
FIG. 14 is a flow chart of the control sequence in the fifth embodiment.

FIG. 14 is a flowchart of the control sequence of the operation for cleaning the secondary transfer roller 8 in this embodiment. The processes in S501-S504 and S506-S510 in FIG. 14 are the same as those in S101-S104 and S105-S109 in FIG. 6, in the first embodiment, and therefore, are not described in detail. In this embodiment, if the control portion 50 determines that the cumulative image formation count N has reached 200, it reads the information which shows the type of the transfer medium P used in the preceding job from the RAM 52 (S505). Then, in this embodiment, the control portion 50 sets the number of times the cleaning operation is to be carried out from the information which was obtained in S505 and shows the type of the transfer medium P to be used in the current job, and the information which was obtained in S505 and shows the type of the transfer medium P used in the preceding job, with reference to Table 5.

In this embodiment, the control portion 50 makes the image forming apparatus 100 carry out the cleaning operation during the pre-rotation period, as described above. Further, the control portion 50 changes the length of time the cleaning operation is to be carried out per preset (unit) number of image formation count, in the current job, based on the information about the smoothness level of the transfer medium P used in the immediately preceding job and the information about the smoothness level of the transfer medium P to be used in the current job. By the way, the pre-rotation period is the period immediately before the sheet of transfer medium P, onto which the first toner image in a job is to be transferred, reaches the secondary transferring portion N2. In this embodiment, the control portion 50 makes shorter, the length of time the cleaning operation is to be carried out when the smoothness level of the transfer medium P to be used for the current job is the second smoothness level which is higher than the first one, than that when the information about the smoothness level of the transfer medium P conveyed to the secondary transferring portion N2 in the immediately preceding job is the first smoothness level. Further, in a case where the transfer medium P to be used in the current job is the same in smoothness level as the transfer medium P used in the immediately preceding job, the control portion 50 makes shorter, the length of time the cleaning operation is to be carried out when the smoothness level which the information about the smoothness level of the transfer medium P to be conveyed to the secondary transferring portion N2 in the current job shows is the fourth smoothness level, which is lower than the third smoothness level, than that when the smoothness level is the third one.

By the way, also in this embodiment, the results of the detection of the smoothness level of the transfer medium P by the smoothness level sensor 13 may be used as the smoothness level information, as in the second embodiment.

In this embodiment, in a case where the cleaning operation is carried out during the pre-rotation period, the length of time the operation for cleaning the secondary transfer roller 8 is to be carried out is changed based on the type of the transfer medium P used in the immediately preceding job, and the type of the transfer medium P to be used for the current job, as described above. Therefore, in a case where the cleaning operation is carried out during the pre-rotation period, it is possible to satisfactorily reduce the amount by which toner particles accumulate on the secondary transfer roller 8, and to prevent the image forming apparatus 100 from carrying out the cleaning operation longer than necessary, in order to prevent the image forming apparatus 100 from being substantially reduced in productivity.

By the way, in this embodiment, the length of time the cleaning operation is to be carried out is changed based on the information regarding the smoothness level of the transfer medium P used in the immediately preceding job, and the information regarding the smoothness level of the transfer medium P to be used in the current job. Therefore, the length of time the cleaning operation is to be carried out is optimized, making this embodiment desirable. However, if an operator desires, the length of time the cleaning operation is carried out during the pre-rotation period may be changed based on only the information about the smoothness of the transfer medium P used in the preceding job. That is, not only may the control portion 50 be enabled to make the image forming apparatus 100 carry out the cleaning operation during the pre-rotation period, but also, it may be enabled to change the length of time the cleaning operation is carried out in the current job, based on the information regarding the smoothness level of the transfer medium P conveyed to the secondary transferring portion N2 in the job which was finished right before the current job. Also in this case, the control portion 50 makes shorter, the length of time the cleaning operation is carried out when the smoothness level which the smoothness level information indicates is the second one which is higher than the first one, than when it is the second one.

Further, the sequence, in this embodiment, for controlling the length of time the cleaning operation is carried out in combination with those in the third and fourth embodiments, which control the length of time the cleaning operation is changed based on the speed with which the transfer medium P is conveyed through the secondary transferring portion N2. That is, the length of time the cleaning operation is to be carried out during the pre-rotation period of the current job when the transfer medium conveyance speed in the preceding job is slower may be made shorter than when the transfer medium conveyance speed in the preceding job is higher, because the toner on the peripheral surface of the secondary transfer roller 8 is more likely to be easily removed when the transfer medium conveyance speed in the preceding job is slower than when the speed is higher. Further, the length of time the cleaning operation is to be carried out during the pre-rotation period for the current job when the transfer medium conveyance speed in the current job is higher may be made shorter than that when the speed is slower, because toner is less likely to transfer from the secondary transfer roller 8 onto the transfer medium P, being therefore less likely to soil the back surface of the transfer medium P, when the transfer medium conveyance speed in the current job is higher, than when the speed is slower. More concretely, all that is necessary is to set the length of time the cleaning operation is to be carried out, based on the relationship among the types of the transfer media P for the preceding and current jobs (or results of detection by smoothness sensor), which were obtained in advance, the transfer medium conveyance speed, and the length of time the cleaning operation is to be carried out during the pre-rotation period of the current job.

That is, the control portion 50 is enabled to change the length of time the cleaning operation is to be carried out, based on the information about the smoothness level of the transfer medium P conveyed to the secondary transferring portion N2 in the job done immediately prior to the current job, and the speed at which the transfer medium P was conveyed through the secondary transferring portion N2 in the immediately preceding job. In this case, the control portion 50 makes shorter, the length of time the cleaning operation is to be carried out when the level of smoothness which the smoothness level information indicates is the second one which is higher than the first one, than that when the smoothness level is the first one. Further, if the transfer medium P used in the preceding job and that for the current job are the same in the smoothness level, the control portion 50 makes shorter, the length of time the cleaning operation is to be carried out when the transfer medium conveyance speed is the second one which is slower than the first one, than when the recording medium conveyance speed is the first one. Further, the control portion 50 is enabled to change the length of time the cleaning operation is to be carried out, based on the information about the smoothness level of the transfer medium P used in the job done immediately prior to the current job, transfer medium conveyance speed in the prior job, information about the smoothness level of the transfer medium P for the prior job, and transfer medium conveyance speed for the current job. In this case, the control portion 50 makes shorter, the length of time the cleaning operation is to be carried out when the smoothness level which the information about the smoothness level of the transfer medium P conveyed to the secondary transferring portion N2 in the immediately preceding job indicated is the second one which is higher than the first one, than when the smoothness level is the first one. Further, if the transfer medium P for the current job is the same in smoothness level as the one used in the immediately preceding job, the control portion 50 makes shorter, the length of time the cleaning operation is to be carried out when the speed at which the transfer medium P was conveyed through the secondary transferring portion N2 in the immediately preceding job is the second one which is slower than the first one, than when the transfer medium conveyance speed in the preceding job was the first one. Further, if the current job is the same as the immediately preceding job, in terms of the smoothness level of the transfer medium P and transfer medium conveyance speed, the control portion 50 makes shorter, the length of time the cleaning operation is to be carried out when the speed at which the transfer medium was conveyed through the secondary transferring portion N2 in the immediately preceding job was the second one which is slower than the first one, than when the transfer medium conveyance speed was the first one. Further, if the current job is the same as the immediately prior job, in the transfer medium smoothness level and transfer medium conveyance speed, the control portion 50 makes shorter, the length of time the cleaning operation is to be carried out when the smoothness level which the information about the smoothness level of the transfer medium P to be used in the current job is the fourth one which is lower than the third one, than when the smoothness level is the third one. Further, if the current job is the same as the immediately prior job, in the transfer medium smoothness level and transfer medium conveyance speed, the control portion 50 makes shorter, the length of time the cleaning operation is to be carried out when the speed with which the transfer medium P is to be conveyed in the current job is the fourth one which is slower than the third one, than that when the transfer medium conveyance speed is the third one.

Further, in a case where the cleaning operation is to be carried out during the pre-rotation period in a given job, it is possible to change the length of time the cleaning operation is to be carried out, based on only the speed with which the transfer medium P is conveyed through the secondary transferring portion N2, and which was mentioned in the description of the third embodiment. That is, the control portion 50 may be enabled to change the length of time the cleaning operation is to be carried out in the current job, based on the speed at which the transfer medium P was conveyed through the secondary transferring portion N2 in the immediately prior job. Also in this case, the control portion 50 makes shorter, the length of time the cleaning operation is to be carried out when the speed with which the transfer medium P is to be conveyed is the second one which is slower than the first one, than that when the transfer medium conveyance speed is the first one. Further, the control portion 50 may be enabled to change the length of time the cleaning operation is to be carried out, based on the speed at which the transfer medium P was conveyed in the immediately prior job, and that with which the transfer medium P is to be conveyed in the current job. In this case, the control portion 50 makes shorter, the length of time the cleaning operation is to be carried out when the speed at which the transfer medium P was conveyed through the secondary transferring portion N2 in the immediately prior job is the second one which is slower than the first one, than that when the transfer medium conveyance speed was the first one. Further, if the current job is the same as the immediately prior job, in the transfer medium conveyance speed, the control portion 50 makes shorter, the length of time the cleaning operation is to be carried out when the speed with which the transfer medium is conveyed through the secondary transferring portion N2 is conveyed in the current job is the fourth one which is higher than the third one, than that when the transfer medium conveyance speed is the third one.

[Miscellanies]

In the foregoing, the present invention was concretely described with reference to the preferred embodiments of the present invention. However, the preceding embodiments are not intended to limit the present invention in scope.

In the preceding embodiments, the length of time, for which the cleaning operation is to be carried out each time a preset number of prints is outputted, was changed by the change in the length of time for which the cleaning operation is to be carried out. However, these embodiments are not intended to limit the present invention in scope. That is, the length of time, for which the cleaning operation is to be carried may be changed by the change in the frequency with which the cleaning operation is to be carried out each time a preset number (unit) of images are outputted. For example, the threshold value (N=200, in preceding embodiments) for the image output count for deciding whether or not the cleaning operation is to be carried out, may be changed to change the interval with which the cleaning operation is to be carried out. In this case, the length of time for which the cleaning operation is to be carried out may be set to a typical one, or may be changed as in the embodiments described above. The image forming apparatus 100 may be structured as follows. That is, the image forming apparatus 100 is provided with the control portion 50 which makes the image forming apparatus 100 carry out the cleaning operation during the sheet interval periods in a continuous job. Here, a continuous job which uses only the first transfer medium P (coated paper, for example), the smoothness level of which is the first one, is referred to as the first continuous job, and a continuous job which uses only the second transfer medium P (ordinary paper and recycled paper, for example), the smoothness level of which is the second one which is lower than the first one, is referred to as the second continuous job. In this case, the number of images which will be outputted between when a cleaning operation is carried out and when the next cleaning operation is carried out in a specific environment, is the first number, in the case of the first continuous job, and the second number, in the case of the second continuous job, which is smaller than the first number. By the way, the reason why the first and second continuous jobs are compared in the preset environment, that is, in practically the same environment, is that there are situations in which the number by which images are to be formed before the cleaning operation is to be carried out, may have to be changed in response to the changes in the environment.

Figure 15:
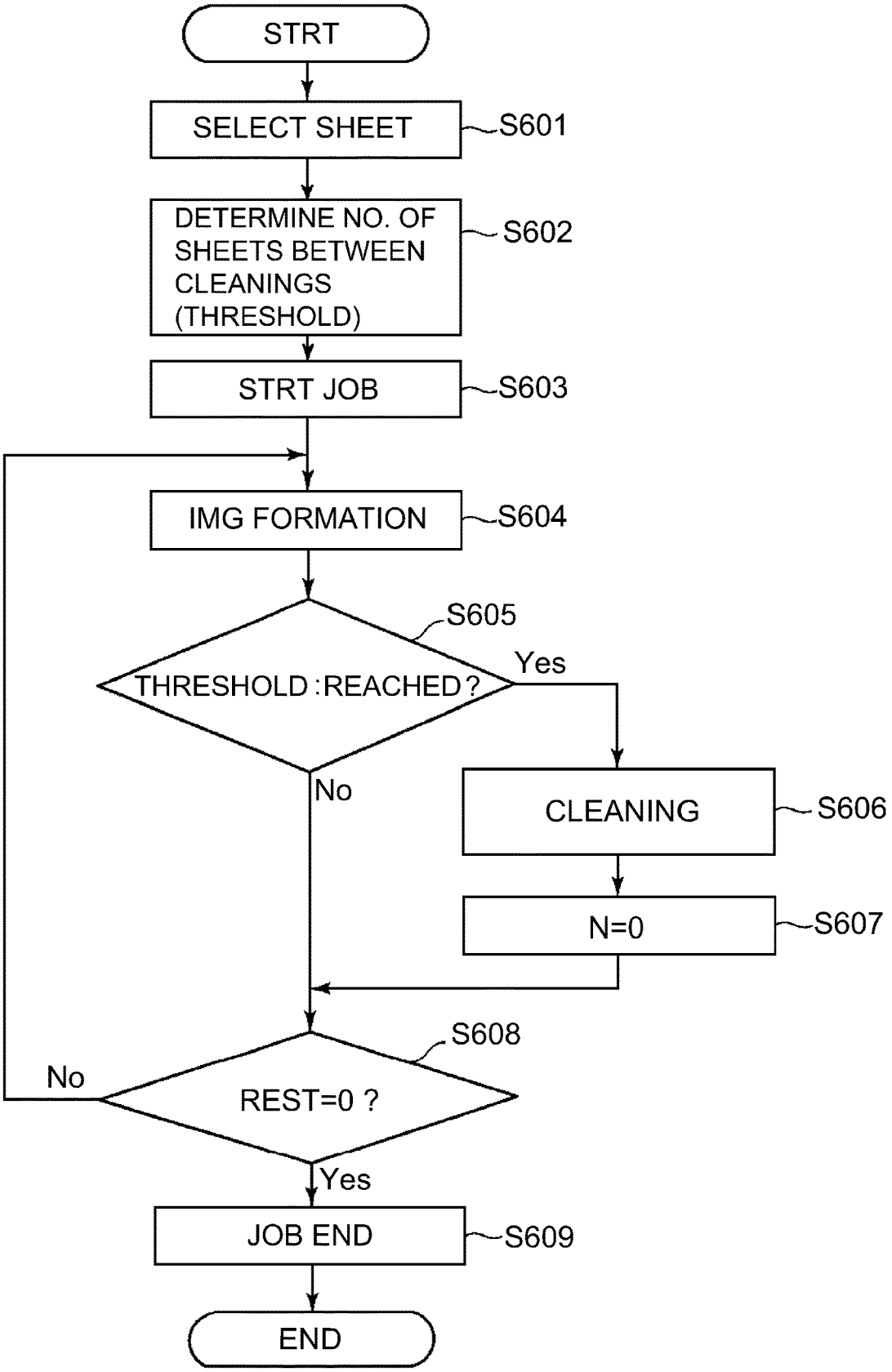
FIG. 15 is a flowchart of the control sequence in another embodiment of the present invention.

At this time, an example of process for changing the frequency with which the cleaning operation is to be carried out when the cleaning operation is to be carried out during the sheet interval period in a continuous job is described with reference to the flowchart in FIG. 15. The control portion 50 obtains the information which shows the type of the transfer medium P selected by an operator with the control panel 12 to be used for the current job, as the information about the smoothness level of the transfer medium P, before it makes the image forming apparatus 100 start the job (S601). Then, the control portion 50 selects one of the frequencies with which the cleaning operation is to be carried out, and which were set in the ROM 53 in advance according to the type of the transfer medium P, that is, the number (threshold value) by which images are to be outputted between a cleaning operation and the next cleaning operation (S602). This number by which images are to be outputted between a cleaning operation and the next one has been set so that the lower the transfer medium P to be used for the current job is in smoothness level, the smaller the number is (that is, higher the frequency with which the cleaning operation is to be carried out). Next, the control portion 50 makes the image forming apparatus 100 start the job (S603). Then, each time an image is formed, the control portion 50 checks whether or not the cumulative number N by which images have been formed in the job has reached the number (threshold value) set in S602 (S605). If it determines, in S605, that the number N by which images have been outputted has reached the number set in S602, it makes the image forming apparatus 100 carry out the cleaning operation (S606). In this case, typically, the length of time for which the cleaning operation is to be carried out during a sheet interval period is not changed. However, it may be changed as in the embodiments described above. Further, in a case where the control portion 50 makes the image forming apparatus 100 carry out the cleaning operation, it resets (sets to initial value, which is 0 in this embodiment) the threshold value for the number by which images are to be outputted before the cleaning operation is to be started (S607). Next, the control portion 50 checks whether or not there remain more images to be outputted (S608). If it determines that there are, it makes the image forming apparatus 100 continue the image forming operation (S604). If it determines that there are none, it makes the image forming apparatus 100 stop the job (S609). Further, if the control portion 50 determines that the number N by which images have been outputted has not reached the value set in S602, it moves to S608.

Further, in the embodiments described above, the frequency (number by which images are to be outputted between the completion of a cleaning operation and the completion of the next cleaning operation) with which the cleaning operation is to be carried out was changed according to the type of the transfer medium P. However, the frequency may be changed according to the speed with which the transfer medium P is conveyed during a continuous job, in addition to the abovementioned factor. That is, the frequency may be set so that the slower the transfer medium conveyance speed is, the lower the frequency is.

Further, in the preceding embodiments, the portion of the image forming apparatus 100, through which the transfer medium type was inputted, was the control panel of the image forming apparatus 100. However, these embodiments are not intended to limit the present invention in scope in terms of the portion through which the transfer medium type is to be inputted. For example, the image forming apparatus 100 may be designed so that the information about the transfer medium type may be inputted into the control portion 50 by way of an external device such as a personal computer connected to the image forming apparatus 100 in such a manner that communication is possible between the image forming apparatus 100 and the external device, and the information can be inputted by an operator who operates the external device. In this case, the communicating means which can receive the information about the transfer medium type from the external device, and can input the information into the control portion functions as the transfer medium type inputting portion. By the way, the transfer medium type may be whether the transfer medium is high quality paper, ordinary paper, recycled paper, coated paper, embossable paper, or vellum paper, that is, the ordinary properties of the transfer medium. It may be a maker name, a brand name, or product number. It may be any index that enables an operator (user) to identify transfer medium type from the standpoint of smoothness (one of surface properties) of the surface of each transfer medium.

Further, in the preceding embodiments, the image forming apparatus 100 was of the so-called intermediary transfer type. However, the present invention is also applicable to an image forming apparatus that has only one image forming portion. In such a case, the transferring member is a member for transferring a toner image from an image bearing member such as the photosensitive drum of the image forming portion, onto transfer medium.

Further, the choice of the transferring member is not limited to a member which is in the form of a roller. For example, it may be a member which is in the form of an endless belt, a pad, or a brush. Further, the choice of the photosensitive member does not need to be limited to a member which is in the form of a drum (photosensitive drum). For example, it may be a member which is in the form of an endless belt (photosensitive belt). Further, the choice of the intermediary transfer belt does not need to be limited to a belt which is in the form of an endless belt. For example, it may be in the form of a drum formed by stretching a piece of film in a manner to cover a cylindrical frame. Further, the present invention is applicable to any image forming apparatus which uses an electrostatic recording method, as long as its image bearing member is a dielectric member which is in the form of a drum or an endless belt, and on which an image is electrostatically recordable.

Further, in the preceding embodiments, the image forming apparatus 100 was structured so that voltage was applicable to the secondary transfer roller 8, and the roller 74 which opposed the secondary transfer roller 8 was grounded. However, the present invention is also applicable to an image forming apparatus structured so that the secondary transfer roller 8 is grounded, and voltage is applied to the roller 74 which opposes the secondary transfer roller 8. Further, the present invention is also applicable to an image forming apparatus structured so that voltage is applicable to at least one of the secondary transfer roller 8 and the roller 74 which opposes the secondary transfer roller 8.

According to the present invention, it is possible to prevent an image forming apparatus from carrying out the operation for cleaning its transferring member longer than necessary. Therefore, it is possible to prevent an image forming apparatus from being reduced in productivity by the operation for cleaning the transferring member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-213277 filed on Nov. 2, 2017, which is hereby incorporated by reference herein in its entirety.

What is claimed is:

1. An image forming apparatus comprising:

a belt configured to bear a toner image;

a first transfer member contacting an outer peripheral surface of said belt and configured to transfer the toner image from said belt onto a transfer material;

a second transfer member opposed to said first transfer member with said belt interposed therebetween to form a transfer portion in cooperation with said first transfer member;

an applying device configured to apply a voltage to at least one of said first and second transfer members;

an input portion configured to input a kind of the transfer material onto which the toner image is to be transferred; and a controller configured to execute a cleaning operation for removing toner deposited on said first transfer member, the cleaning operation including an operation for applying a first voltage having a polarity same as a regular charge polarity of the toner and a second voltage having a polarity opposite to the regular charge polarity in a period after a transfer material passes through said transfer portion and before a next transfer material reaches the transfer portion, in a continuous job for transferring images onto transfer materials continuously;

wherein said controller is capable of changing a number of image formations N to be carried out from a performance of the cleaning operation to a next performance of the cleaning operation on the basis of the kind of the transfer material inputted by said input portion, wherein the number of image formations N controlled by said controller is a first number in a case of the kind of the transfer materials being coated paper, and is a second number in a case of the kind of the transfer materials being plain paper, wherein the second number is less than the first number, and wherein said controller changes the number of image formations N on the basis of the kind of the transfer materials in an immediately preceding job.

2. The apparatus according to claim 1, wherein the number of image formations N controlled by said controller is a third number less than the second number in a case of the kind of the transfer materials in the preceding job being plain paper and the kind of the transfer materials in a current job being coated paper.

3. The apparatus according to claim 1, wherein the number of image formations N controlled by said controller is the first number in a case of the kind of the transfer materials in the preceding job being coated paper and the kind of the transfer materials in a current job being plain paper.

* * * * *